US008267077B2

(12) United States Patent
Kaakkola et al.

(10) Patent No.: US 8,267,077 B2
(45) **Date of Patent: *Sep. 18, 2012**

(54) PAINTBALL MARKER

(75) Inventors: Eero Kaakkola, San Diego, CA (US); Richard Corlett, San Diego, CA (US); William Wing, San Diego, CA (US); Adam H. Thorp, San Diego, CA (US)

(73) Assignee: Dye Precision, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/210,285

(22) Filed: Aug. 15, 2011

(65) Prior Publication Data

US 2011/0297136 A1 Dec. 8, 2011

Related U.S. Application Data

(63) Continuation of application No. 11/868,250, filed on Oct. 5, 2007, now Pat. No. 7,997,260.

(51) Int. Cl.
*F41B 11/00* (2006.01)

(52) U.S. Cl. ..... 124/74

(58) Field of Classification Search ..... None
See application file for complete search history.

(56) References Cited

U.S. PATENT DOCUMENTS

| | | | | |
|---|---|---|---|---|
| 2,275,723 A | | 3/1942 | Benjamin | |
| 2,881,752 A | | 4/1959 | Blahnik | |
| 3,204,625 A | | 9/1965 | Shepherd | |
| 4,227,508 A | | 10/1980 | D'Andrade | |
| 4,369,759 A | | 1/1983 | Gerstenberger et al. | |
| 4,644,930 A | | 2/1987 | Mainhardt | |
| 4,850,330 A | | 7/1989 | Nagayohsi | |
| 4,936,282 A | | 6/1990 | Dobbins et al. | |
| 5,063,905 A | * | 11/1991 | Farrell | 124/72 |
| 5,078,118 A | | 1/1992 | Perrone | |
| 5,253,873 A | | 10/1993 | Grattan | |
| 5,257,614 A | * | 11/1993 | Sullivan | 124/73 |

(Continued)

FOREIGN PATENT DOCUMENTS

GB 2418007 A 3/2006

(Continued)

OTHER PUBLICATIONS

European Patent Office; International Search Report for International Application No. PCT/US2008/078622, International filing date Oct. 2, 2008; dated May 20, 2009.

(Continued)

*Primary Examiner* — Michael Carone
*Assistant Examiner* — Samir Abdosh
(74) *Attorney, Agent, or Firm* — Knobbe Martens Olson & Bear, LLP

(57) ABSTRACT

A pneumatic paintball marker has, for example, a sleeve that controls the passage of air through the longitudinal barrel or opening within the marker. By sequentially filling separate chambers defined within the opening and the sleeve, the sleeve is able to translate axially through the opening in a sequential manner. When the sleeve is in a forward position, air is caused to be released through the barrel, propelling the paintball. A sear member engages the sleeve and prevents it from inadvertently moving to a forward position. Air filling the chambers returns the sleeve to the loading position.

26 Claims, 22 Drawing Sheets

U.S. PATENT DOCUMENTS

| | | | | |
|---|---|---|---|---|
| 5,265,582 | A | 11/1993 | Bhogal | |
| 5,280,778 | A | 1/1994 | Kotsiopoulos | |
| 5,339,791 | A * | 8/1994 | Sullivan | 124/73 |
| 5,349,938 | A * | 9/1994 | Farrell | 124/73 |
| 5,383,442 | A | 1/1995 | Tippmann | |
| 5,497,758 | A * | 3/1996 | Dobbins et al. | 124/73 |
| 5,505,188 | A | 4/1996 | Williams | |
| 5,509,399 | A | 4/1996 | Poor | |
| 5,572,982 | A | 11/1996 | Williams | |
| 5,613,483 | A | 3/1997 | Lukas et al. | |
| 5,727,538 | A | 3/1998 | Ellis | |
| 5,950,611 | A | 9/1999 | Lopez et al. | |
| 5,954,043 | A * | 9/1999 | Mayville et al. | 124/75 |
| 6,035,843 | A | 3/2000 | Smith et al. | |
| 6,142,137 | A | 11/2000 | MacLaughlin | |
| 6,405,722 | B2 | 6/2002 | Colby | |
| 6,470,872 | B1 * | 10/2002 | Tiberius et al. | 124/74 |
| 6,520,172 | B2 | 2/2003 | Perrone | |
| 6,532,949 | B1 | 3/2003 | McKendrick | |
| 6,644,295 | B2 | 11/2003 | Jones | |
| 6,708,685 | B2 | 3/2004 | Masse | |
| 6,807,959 | B1 | 10/2004 | Murdock et al. | |
| 6,889,682 | B2 | 5/2005 | Styles et al. | |
| 6,966,313 | B1 | 11/2005 | Yokota et al. | |
| 7,107,981 | B1 | 9/2006 | Dunn | |
| 7,111,621 | B2 * | 9/2006 | Lin | 124/74 |
| 7,121,272 | B2 | 10/2006 | Jones | |
| 7,159,585 | B2 | 1/2007 | Quinn et al. | |
| 7,185,646 | B2 | 3/2007 | Jones | |
| 7,237,544 | B2 | 7/2007 | Jones | |
| 7,347,220 | B2 | 3/2008 | Carpenter et al. | |
| 7,387,117 | B2 | 6/2008 | Kunimoto | |
| 7,395,819 | B2 * | 7/2008 | Dobbins et al. | 124/71 |
| 7,527,049 | B2 | 5/2009 | Sheng | |
| 7,640,923 | B1 | 1/2010 | Chen | |
| 2002/0088449 | A1 * | 7/2002 | Perrone | 124/74 |
| 2002/0096164 | A1 | 7/2002 | Perrone | |
| 2003/0005918 | A1 | 1/2003 | Jones | |
| 2003/0131834 | A1 | 7/2003 | Rice et al. | |
| 2003/0168052 | A1 | 9/2003 | Masse | |
| 2004/0084040 | A1 | 5/2004 | Jones | |
| 2004/0154600 | A1 | 8/2004 | Jong | |
| 2004/0216728 | A1 | 11/2004 | Jong | |
| 2005/0011507 | A1 | 1/2005 | Webb | |
| 2005/0115554 | A1 | 6/2005 | Jones | |
| 2005/0188973 | A1 | 9/2005 | Monks | |
| 2006/0011186 | A1 | 1/2006 | Jones et al. | |
| 2006/0011188 | A1 * | 1/2006 | Jones | 124/77 |
| 2006/0042616 | A1 | 3/2006 | Orr | |
| 2006/0207587 | A1 | 9/2006 | Jones et al. | |
| 2007/0062509 | A1 | 3/2007 | Campo et al. | |
| 2007/0068502 | A1 | 3/2007 | Jones et al. | |
| 2007/0181117 | A1 * | 8/2007 | Tippmann et al. | 124/74 |
| 2007/0186916 | A1 * | 8/2007 | Jones | 124/74 |
| 2007/0209650 | A1 | 9/2007 | Jones | |
| 2007/0215134 | A1 | 9/2007 | DeHaan et al. | |
| 2007/0267005 | A1 | 11/2007 | Yeh | |
| 2008/0078370 | A1 | 4/2008 | Kaakkola et al. | |
| 2008/0099005 | A1 * | 5/2008 | Kaakkola et al. | 124/74 |
| 2008/0105245 | A1 | 5/2008 | Cole | |
| 2008/0245351 | A1 | 10/2008 | Kaakkola | |
| 2008/0264399 | A1 * | 10/2008 | Dobbins et al. | 124/71 |
| 2009/0032003 | A1 * | 2/2009 | Masse | 124/73 |
| 2009/0064981 | A1 * | 3/2009 | Dobbins et al. | 124/71 |
| 2009/0199831 | A1 * | 8/2009 | Telford et al. | 124/71 |
| 2010/0051007 | A1 | 3/2010 | Telford et al. | |
| 2010/0154766 | A1 | 6/2010 | Skilling | |

FOREIGN PATENT DOCUMENTS

| | | | |
|---|---|---|---|
| WO | WO 2005/033612 | A1 | 4/2005 |
| WO | WO 2005/080905 | A2 | 9/2005 |
| WO | WO 2006/073479 | A2 | 7/2006 |

OTHER PUBLICATIONS

European Patent Office; International Search Report for International Application No. PCT/US2005/018474; International filing date May 25, 2005; dated Dec. 15, 2005.

European Patent Office; International Search Report for International Application No. PCT/US2007/079583, International filing date Sep. 26, 2007; dated Apr. 3, 2008.

European Patent Office; Written Opinion of the International Searching Authority for International Application No. PCT/US2008/078622, International filing date Oct. 2 2008; dated Apr. 5, 2010.

* cited by examiner

PAINTBALL MARKER

CROSS-REFERENCE TO RELATED APPLICATIONS

This application is a continuation of copending U.S. patent application Ser. No. 11/868,250, filed Oct. 5, 2007, entitled "Paintball Marker", which is hereby incorporated by reference in its entirety.

BACKGROUND OF THE INVENTION

1. Field of the Invention

The present invention relates to pneumatic guns. More specifically, this invention relates to a paintball marker.

2. Description of the Related Art

This invention relates to pneumatic paintball markers, which typically are used for target practice and in mock war games. The markers use a compressed gas, such as air or nitrogen, to propel spherical projectiles called paintballs out of the barrel of the device. Paintballs are typically comprised of a colored liquid enclosed in a fragile gelatin casing. The paintballs are designed to rupture upon impact to mark the target.

In the sport known as "Paintball," the spherical projectiles containing colored liquid are fired at an opponent and burst upon contact so that the colored liquid is deposited on the opponent, scoring a hit for the combatant. All the participants involved in the sport are required to wear an abundance of protective gear, so that the paintballs can not hit vital parts of the player's anatomy. The sport of paintball has become very popular within a relatively short period of time, but there is still a need for a pneumatic paintball marker with improved features.

SUMMARY OF THE INVENTION

In view of the foregoing, a need exists for an improved pneumatic marker.

An aspect of the invention is directed to a marker that has an outer member. The outer member has an opening disposed generally axially therethrough and a gas inlet passage. The marker further includes a sleeve slidingly received within the outer member and configured to move between a first position and a second position. The marker further includes a first chamber at least partially defined between the outer member and the sleeve. The first chamber is in flow communication with the gas inlet passage when the sleeve is in the first position and in the second position. The marker further includes a second chamber at least partially defined within the sleeve and a passageway. The passageway is disposed between the first chamber and the second chamber. The passageway is sized with respect to the gas inlet passage so as to impede the gas entering the first chamber from entering the second chamber at least when the sleeve is moving from the second position to the first position.

Another aspect is directed a marker that has an outer member. The outer member has an opening disposed generally axially therethrough and a gas inlet passage. The gas inlet passage extends through the outer member and is in flow communication with a pressurized gas source. The marker further comprises a member slidingly received within the outer member and configured to slide between a first position and a second position. The member has a first pressure surface. The marker further includes a first chamber and a second chamber. The first chamber is in flow communication with the gas inlet passage when the piston is in the first position and in the second position. The first chamber has a second pressure surface substantially opposing the first pressure surface and being sized so that the piston is biased towards the second position when the first chamber and the second chamber are at substantially equal pressures. The marker further includes an open area disposed between the first chamber and the second chamber. The open area is sized so as to slow the gas entering the first chamber from entering the second chamber at least when the piston is moving from the second position to the first position.

Another aspect is directed to a gas pressurized paintball marker that has a housing. The housing has an opening disposed generally axially therethrough and defines one or more interior surfaces. The marker further includes a sleeve defining one or more exterior surfaces configured to be slidably received by the one or more interior surfaces of the opening. The marker further includes a frame in communication with a bottom surface of the housing and defines a handgrip. The marker further includes a trigger disposed within the frame and a first air chamber and a second air chamber defined within the housing. The marker further includes a sear member that releasably engages the sleeve at a predetermined axial position.

Another aspect is directed to a gas pressurized paintball marker that has a body portion defining an axial cylinder having an interior surface and an inlet passage for receiving gas. The marker further includes a sleeve slidingly received by the axial cylinder and a first air chamber at least partially defined between the interior surface and the sleeve. The first air chamber is in continuous flow communication with the inlet passage. The marker further includes a second air chamber at least partially defined by the sleeve. The second air chamber is in flow communication with the first air chamber. The marker further including an orifice sized and shaped to inhibit flow from the first chamber to the second chamber and a trigger member that releasably engages the sleeve.

Another aspect is directed to a pressure relief valve for reducing a fluid pressure within a pressure vessel. The valve includes a first body defining a chamber having an inner surface, the first body having at least two openings, each opening being in fluid communication with a fluid and a second body configured to translate axially within the chamber between a first position and a second position, wherein the fluid applies a force on the second body so as to bias the second body toward the first position. The valve further includes a third opening in fluid communication with the chamber and an ambient environment so as to allow the fluid to exit through the third opening when the second body is in the second position. The fluid is inhibited from exiting through the third opening when the second body is in the first position. An external force exerted on the second body is greater than the biasing force causes the second body to translate axially toward the second position.

The systems and methods of the invention have several features, no single one of which is solely responsible for its desirable attributes. Without limiting the scope of the invention as expressed by the claims, its more prominent features have been discussed briefly above. After considering this discussion, and particularly after reading the section entitled "Detailed Description of the Preferred Embodiments," one will understand how the features of the system and methods provide several advantages over conventional paintball markers.

BRIEF DESCRIPTION OF THE DRAWINGS

These and other features, aspects and advantages of the present invention will now be described in connection with preferred embodiments of the invention, in reference to the accompanying drawings. The illustrated embodiments, however, are merely examples and are not intended to limit the invention. The following are brief descriptions of the drawings.

DETAILED DESCRIPTION OF THE PREFERRED EMBODIMENTS

The following detailed description is now directed to certain specific embodiments of the invention. In this description, reference is made to the drawings wherein like parts are designated with like numerals throughout the description and the drawings.

Figure 1:
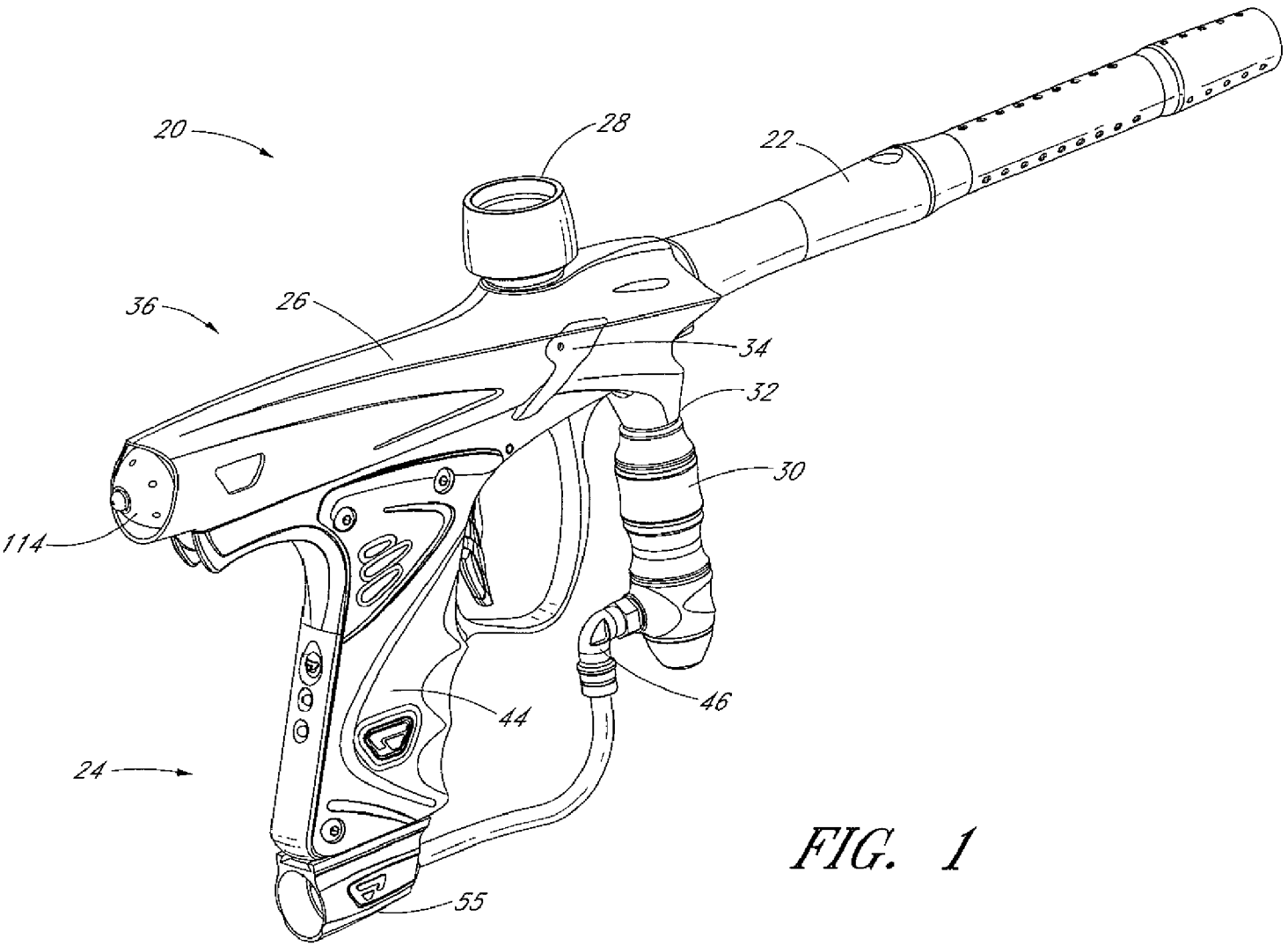
FIG. 1 depicts a perspective view of a pneumatic paintball marker according to a preferred embodiment of the present invention.
Figure 3:
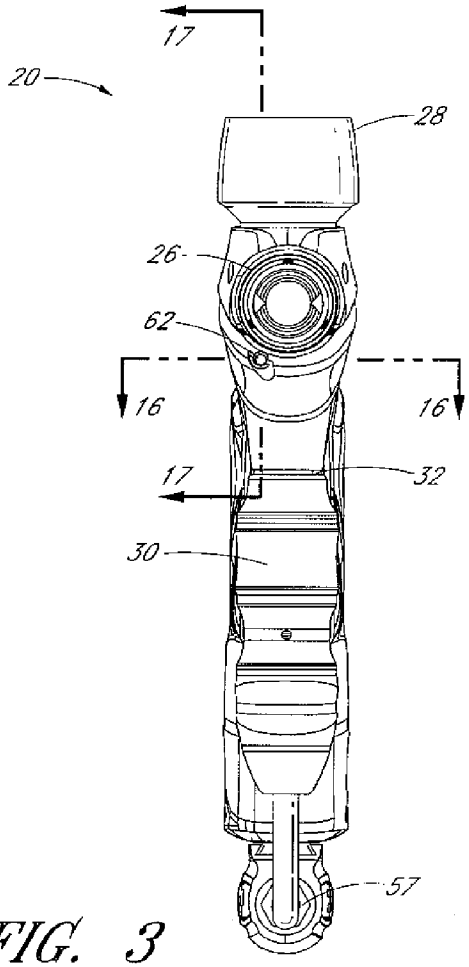
FIG. 3 is a front view of the pneumatic paintball marker from FIG. 1.
Figure 2:
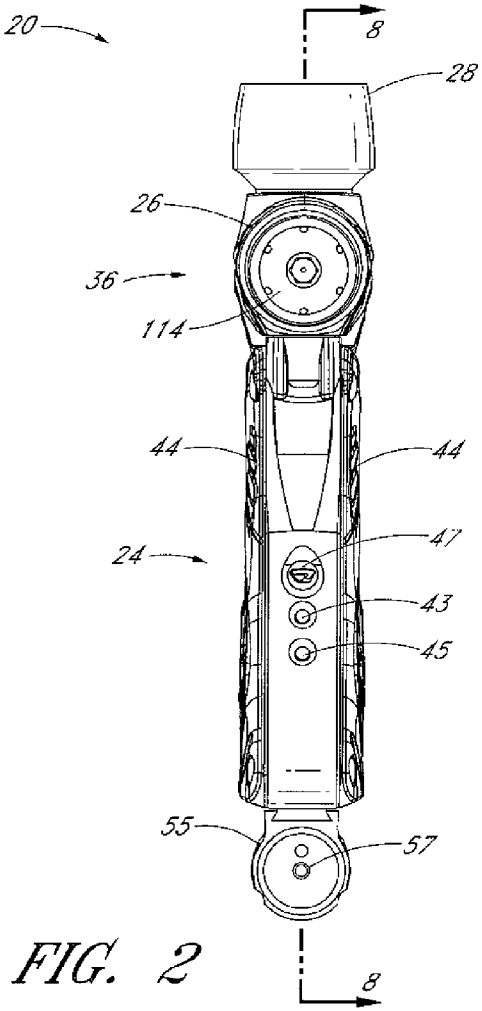
FIG. 2 is a rear view of the pneumatic paintball marker from FIG. 1.

FIG. 1 depicts a perspective view of a pneumatic paintball marker 20 according to a preferred embodiment of the present invention. FIG. 2 is a rear view of the pneumatic paintball marker 20 from FIG. 1. FIG. 3 is a front view of the pneumatic paintball marker 20 from FIG. 1. The pneumatic paintball marker 20 includes a housing or body 26, a sleeve 36, and a handgrip frame 24. A barrel 22 is located at the front of the body 26.

Figure 4A:
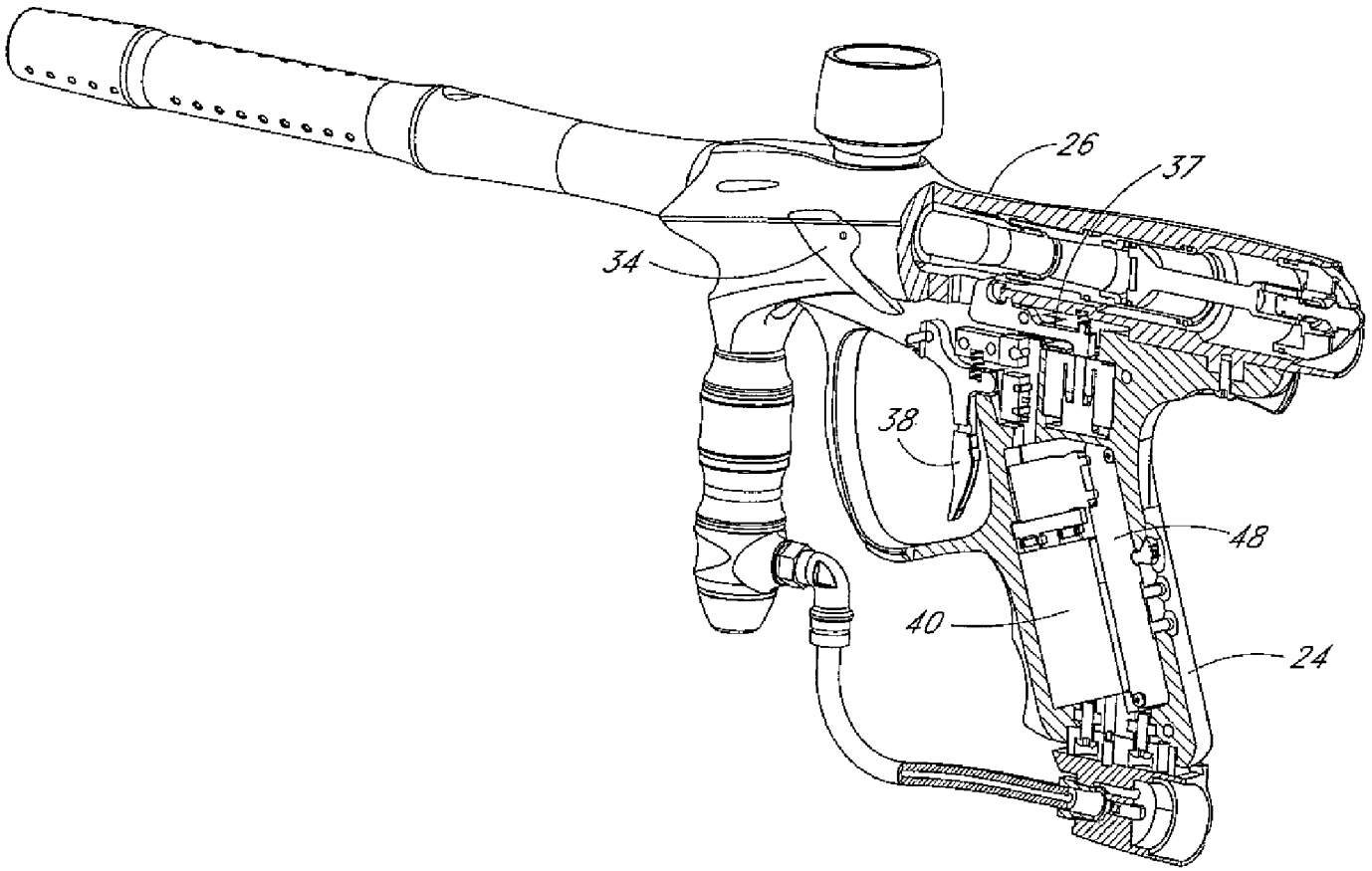
FIG. 4A is a partial cross-section through the pneumatic paintball marker from FIG. 1.
Figure 4B:
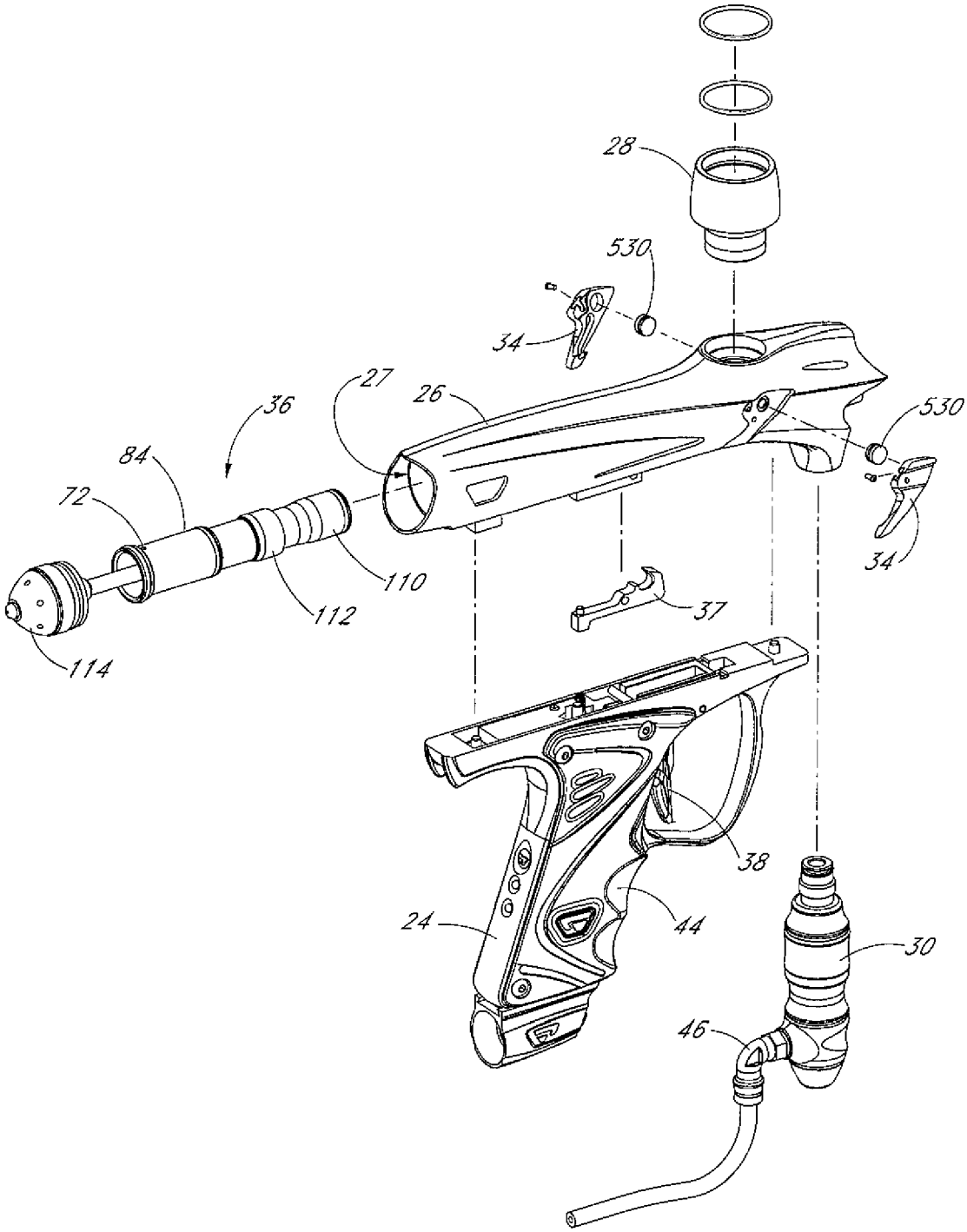
FIG. 4B is an exploded perspective view of the right side of the pneumatic paintball marker from FIG. 1.

FIG. 4A is a partial cross-section through the pneumatic paintball marker 20 from FIG. 1. FIG. 4B is an exploded perspective view of a right side of the pneumatic paintball marker 20 from FIG. 1. As most clearly shown in FIG. 4B, the housing or body 26 is a one-piece body. Of course the body 26 is not limited to a unitary or one-piece structure and need only include an opening or cavity 27 configured to receive a sliding sleeve 36. For example, the body 26 may comprise an inner body member and an outer body member with the inner body member forming the opening or cavity 27. The outer body member may have a clamshell like shape around the inner body member. An outer surface of the body 26 may have a gun-shape or any other shape. In one embodiment, the body 26 is manufactured as a single metal piece with a computer numerically controlled ("CNC") machine.

The opening or cavity 27 is configured to receive the sleeve 36. In the illustrated embodiment, the opening or cavity 27 has a cylindrical shape which generally matches the outer shape of the sleeve 36. Of course the shape of the cavity 27 need not be cylindrical for the sleeve 36 to reciprocate within the cavity 27. The shape of the cavity 27 need not match the outer shape of the sleeve 36 to permit the sleeve 36 to reciprocate relative to the cavity 37. The opening or cavity 27 is generally disposed co-linear with the longitudinal axis of the barrel 22. At least a portion of the sleeve 36 reciprocates within the opening or cavity 27 in the body 26. The sleeve 36 may move between a forward and a back or aft position.

The pneumatic paintball marker 20 includes an in-line pressure regulator 30 and an airport adapter 55. Gas from the gas supply source passes through the airport adapter 55 and enters the in-line regulator 30. The in-line pressure regulator 30 threads into an in-line pressure regulator adapter 32. The adapter 32 is attached at the front of the body 26 of the pneumatic paintball marker 20 below the barrel 22.

The regulator 30 receives high pressure gas, such as air or nitrogen, and supplies the gas to the pneumatic paintball marker 20. In some embodiments, a user may adjust the in-line regulator 30 to select a desired operating air pressure for the marker 20. A wide variety of compressed gases will work equally well within the pneumatic paintball marker 20, as well as compressed air. For ease of explanation, compressed air is used as an exemplary compressed gas throughout the description.

High-pressure compressed air is supplied to the in-line pressure regulator 30 via air fitting 46. In one embodiment, the in-line pressure regulator 30 preferably adjusts the pressure of the compressed gas within a 350-3100 kPa range. The pressurized gas source need not be turned off during operation of the marker 20.

The output pressure of the in-line pressure regulator 30 may be adjusted by turning a metal air regulating screw located up inside the base of the in-line pressure regulator 30. For example, by turning the air regulating screw counterclockwise a user increases the output pressure of the in-line pressure regulator 30 to the pneumatic paintball marker 20. Similarly, by turning the air regulating screw clockwise the user decreases the output pressure of the in-line pressure regulator 30 to the pneumatic paintball marker 20.

As shown most clearly in FIG. 4B, the pneumatic paintball marker 20 may include an anti-chop eye system. Removable cover plates 34 on either side of the body 26 allow a user to access the anti-chop eye system. The anti-chop system is further described with reference to FIGS. 18 and 19. The anti-chop system is also described in U.S. patent application Ser. No. 11/540,924, filed on Sep. 28, 2006, and entitled SELF CLEANING ANTI CHOP EYES FOR A PAINTBALL MARKER, which is expressly incorporated by reference in its entirety.

The marker 20 comprises a handgrip frame 24 that is located below the body 26. The handgrip frame 24 may be made from a single material or a combination of materials such as, for example, plastic and metal materials. Further, different types of plastics may be used for the handgrip frame 24. For example, the handgrip frame 24 may principally comprise a combination of Nylon and glass fibers.

As is illustrated in FIG. 4A, the handgrip frame 24 houses the electronics of the pneumatic paintball marker 20. The electronics are arranged on a circuit board 48 and further include a power source or battery 40. The battery 20 or capacitor supplies power to the pneumatic paintball marker 20.

The electronics may include, for example, an arrangement of resistors, capacitors, and transistors which supply a signal to a processor running software. The electronics control some or all operational aspects of the paintball marker 20. For example, the electronics inhibit the pneumatic paintball marker 20 from breaking the paintballs within the marker by not allowing the pneumatic paintball marker 20 to fire until a paintball is fully seated in a breech in front of the sleeve 36. The processor can receive data coming from the anti-chop eye system to determine whether the paintball is correctly positioned within the breech.

Figure 5:
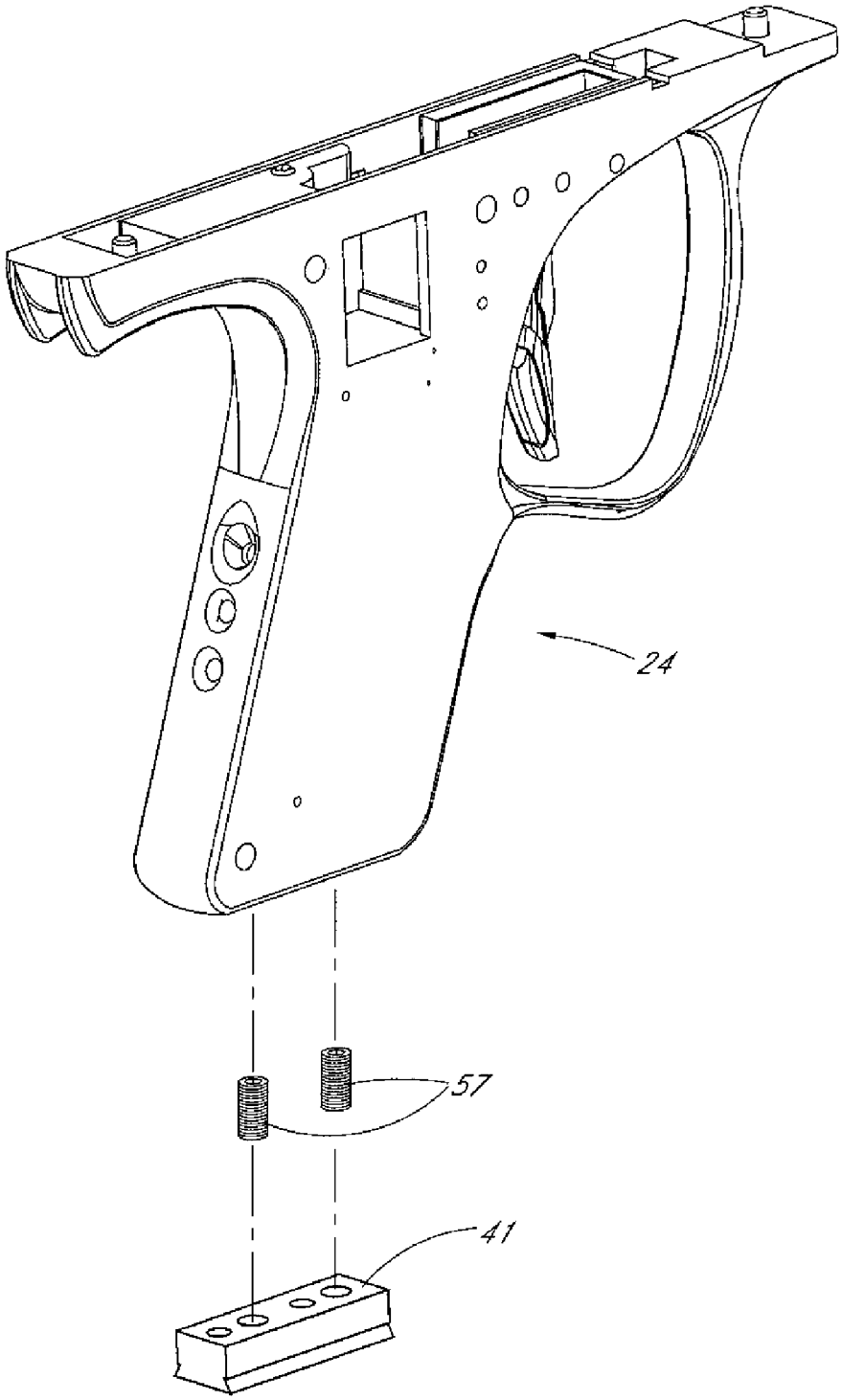
FIG. 5 is an exploded perspective view of an airport insert that comprises a different material than the handgrip frame.

FIG. 5 is an exploded perspective view of an airport insert 41 for the handgrip frame 24. The airport insert 41 is disposed within a lower portion of the handgrip frame 24 and includes a dovetail shaped bottom surface for slidingly receiving an airport adapter 55. For embodiments of the handgrip frame 24 that comprise a plastic or the like, the airport insert 41 preferably comprises a stronger material. For example, the airport insert 41 may comprise a metal, such as aluminum, or an alloy, while the handgrip frame 24 comprises a nylon material. The selection of a metal for the airport insert 41 advantageously provides a suitably rigid structure for attaching the airport adapter 55 and air supply tank.

Figure 6:
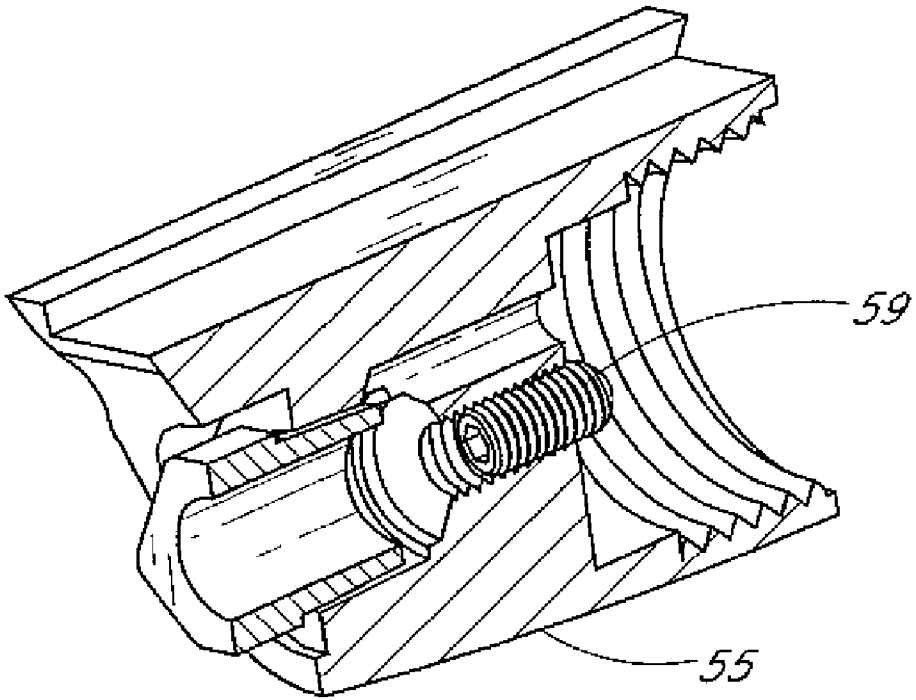
FIG. 6 is a cross-sectional view through the center of the airport adapter from FIG. 1 showing an adjustable pin within the airport.

FIG. 6 is a cross-section through the center of the airport adapter 55 showing a pin depressor 59. As most clearly shown in FIG. 2, the airport adapter 55 preferably includes a channel having a truncated cross-sectional shape that runs along an upper surface of the airport adapter 55. The channel is disposed so that, as the airport adapter 55 is slid on the airport insert 41, the dovetail shaped bottom surface of the airport insert 41 slidingly engages the channel of the airport adapter 55. A user may turn a screw 57 to fix the longitudinal location of the airport adapter 55 relative to the airport insert 41.

The rear side of the airport adapter 55 engages with the air supply tank via, for example, a threaded connection. The distance that the pin depressor 59 extends towards the engaged air tank is preferably adjustable so as to accommodate different dimensions of gas tanks. A user preferably accesses the pin depressor 59 by removing an air hose from the front of the airport adapter 55. A user may adjust or fine tune the extension length of the pin depressor 59 by rotating the pin depressor 59 via a set screw in the pin depressor 59 to achieve the desired flow from the selected gas tank.

Figure 7:
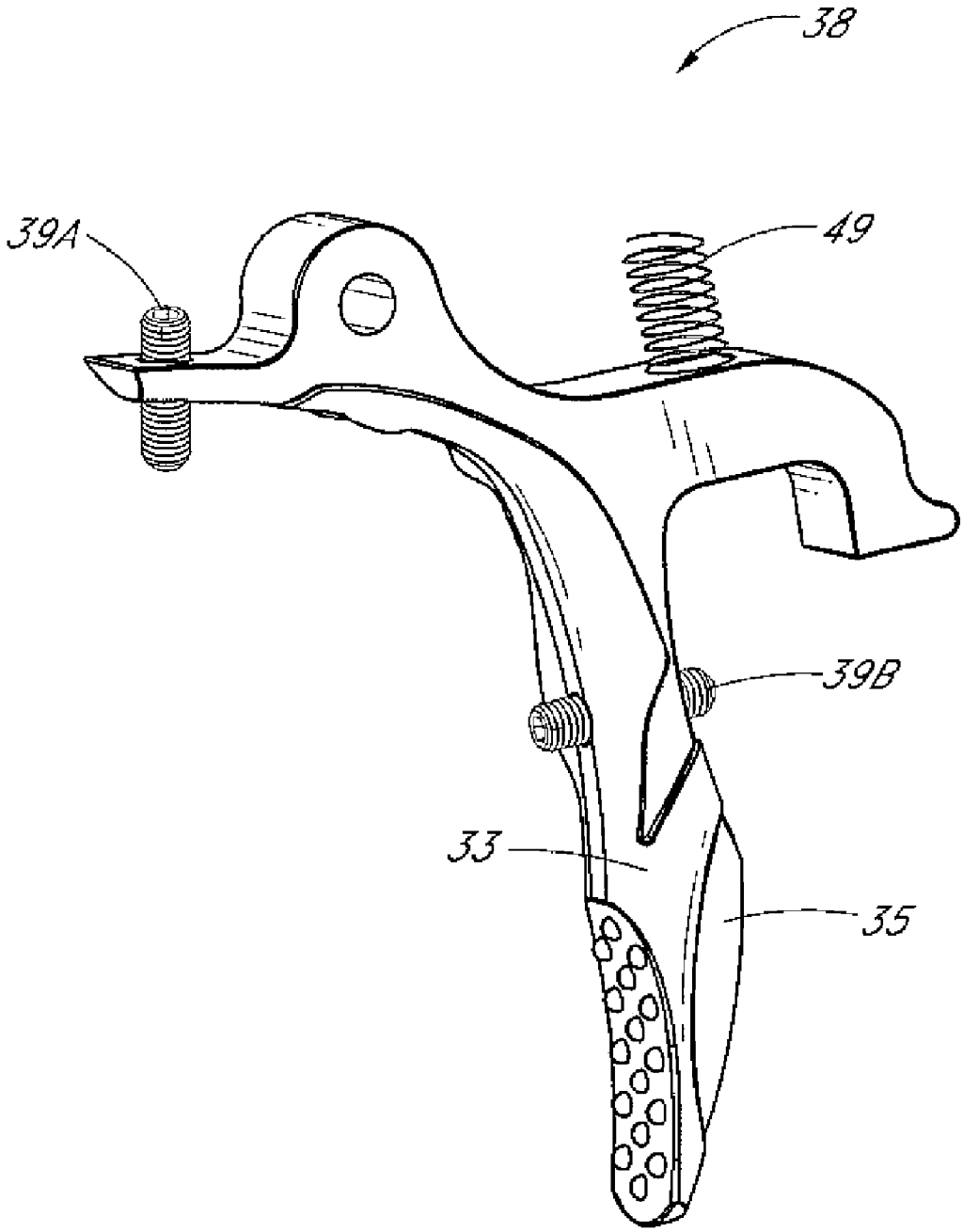
FIG. 7 is a perspective view of a trigger for the pneumatic paintball marker that comprises a higher grip outer surface material molded to a base trigger structure.
Figure 8:
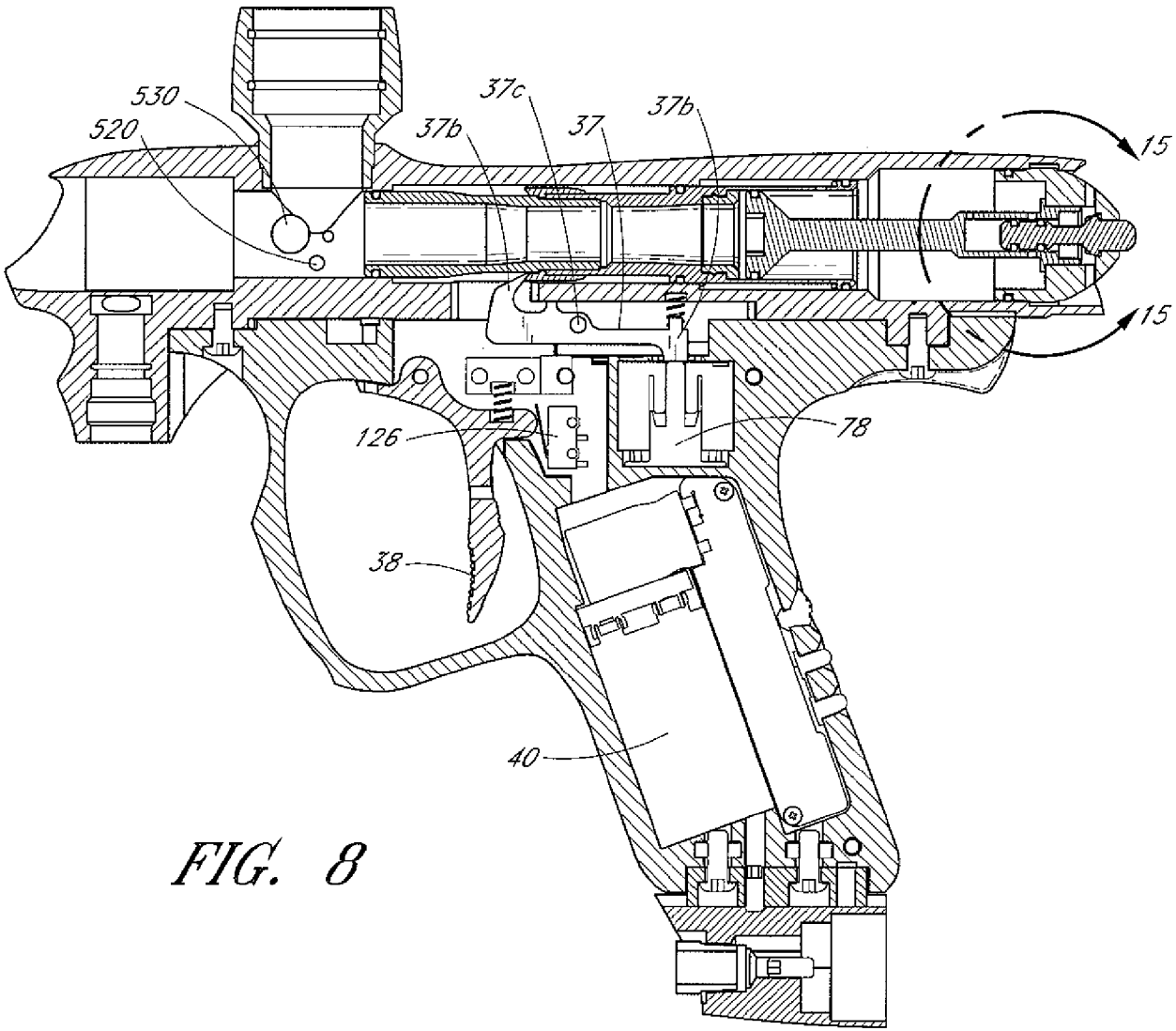
FIG. 8 is a cross-section through the center of the pneumatic paintball marker taken along lines 8-8 of FIG. 2 with a sleeve in a loading position.

FIG. 7 is a perspective view of a trigger 38 for the pneumatic paintball marker 20. FIG. 8 is a cross-section through the center of the pneumatic paintball marker 20 taken along lines 8-8 of FIG. 2 with the sleeve 36 in a loading position and the trigger 38 in a forward position. The trigger 38 mechanically actuates a micro switch 126. Signals from the micro switch 126 control the operation of an actuator 78. The actuator 78 may be a solenoid or other suitable device. The actuator 78 actuates a sear member 37 which engages and disengages with the sleeve 36.

The illustrated embodiment of the trigger 38 comprises a higher grip outer surface material 33 molded to a base trigger structure 35. The outer surface material 33 and the rear surface of the handgrip frame 24 may comprise a softer material, such as, for example, a thermo plastic elastomer (TPE). In another embodiment, the trigger 38 is formed integrally from a single material.

The forward and over travels of the trigger 38 are user adjustable. A screw 39A located on top front of the trigger 38 is used to control the forward travel of the trigger 38. For example, turning the screw 39A shortens the length of pull. A screw 39B located on the back of the trigger 38 controls the over travel. For example, turning the screw 39B will adjust how far back the trigger 38 will travel. A spring 49 biases the trigger 38 in a downward direction so as to rotate the trigger 38 away from the micro switch 126.

As most clearly illustrated in FIGS. 1-3 and 4B, the handgrip frame 24 may be enclosed on the sides and front by a grip cover 44. The grip cover 44 may comprise urethane, plastic, or other similar or suitable materials. Alternatively, the grip cover 44 may comprise a combination of materials, for example, a poly propylene base and a thermo plastic elastomer (TPE) outer surface.

As most clearly illustrated in FIG. 2, the marker 20 is turned on using the on/off switch 43. To activate or de-activate the pneumatic paintball marker 20, the user will press the on or off button on the rear portion 51 at the back of the handgrip frame 24. the button contacts the switch 43. The lamp 47 turns on when the marker 20 is on. The anti-chop eye feature is turned on or off using switch 45. The lamp 47 blinks, for example a red color, indicating that the anti-chop eye feature is turned off.

In one embodiment, in the normal operation mode, the lamp 47 indicates the following information: Yellow: Boot Up Sequence; Red: No ball detected inside the marker 20, anti-chop eye feature is turned on; Green: Ball detected inside the marker 20, anti-chop eye feature is turned on; Blinking red: Anti-chop eye feature is turned off; and Blinking green: Anti-chop eye feature is blocked by, for example, dirt or paint; the marker 20 is not pressurized; there is a bad connection between the electronics and the anti-chop eye feature; or the battery 40 is low. In another embodiment, in the normal operation mode, the lamp 47 indicates the previously listed information except that it does not indicate a low battery condition.

The electronics may be configured or customized by a user. For example, the marker 20 may have five configuration settings including settings for an ABS (Anti-Bolt Stick) feature, trigger sensitivity, ROF (Rate Of Fire), and Fire Mode. For example, the Anti-Bolt Stick feature can be changed by turning a DIP switch on the circuit board 48 either ON or OFF.

The trigger sensitivity, ROF (Rate of Fire), and fire mode features may be altered from a configuration mode. For example, to activate the configuration mode the user turns the marker 20 off and opens the grip cover 44 to expose the circuit board 48. The user may adjust a DIP switch to the on position to enter the configuration mode. Next, the user turns the marker 20 on. The user pulls the trigger 38 to cycle through the different settings.

The trigger sensitivity may be set to values from one to twenty and corresponds to the amount of time that the trigger 38 has to be released before the next trigger 38 pull is recognized. The rate of fire may be set to values from one to twenty, with twenty having the highest rate of fire. The fire mode may preferably be set to values from one to four. Mode one corresponds to a semi automatic mode. Mode two corresponds to a Millennium mode for Millennium play. Mode three corresponds to a PSP mode for PSP play. Mode four corresponds to fully automatic mode.

The settings for the trigger sensitivity, ROF (Rate of Fire), and fire mode features may be changed when in the configuration mode by cycling through the modes using the trigger 38 and then pulling the trigger 38 a number of times corresponding to the selected value for the selected feature.

The barrel 22 may be a one-piece or multi-piece type barrel. The barrel 22 may thread into the front of the body 26 of the pneumatic paintball marker 20. A paintball loading chamber is disposed on the top of the body 26 and may comprise an adjustable feed neck 28 to fit paintball loaders of different dimensions.

As most clearly shown in FIG. 2, at the rear of the body 26 is an exposed rear portion or rear cap 114. The rear cap 114 is partially inset within the body 26. At least a portion of the rear cap 114 is fastened to the body 26 by, for example, a threaded connection. A user may remove the rear cap 114 to access the sleeve 36. After removing the rear cap 114, the sleeve 36 can be removed from the body 26.

Preferably, the marker 20 comprises few moving components for ease of rapid operation. In the illustrated embodiment, the marker 20 comprises three parts that substantially move. The parts that substantially move are the sleeve 36, a latch mechanism or sear member 37, and the trigger 38. Other parts such as but not limited to the ball detents 530 on either side of the body 26, micro switch 126, actuator 78, and spring 111 undergo some minor or less substantial movement. Of course the marker 20 is not limited by the number of moving components or the degree of movement by those parts and may comprise more or less moving parts.

Figure 10:
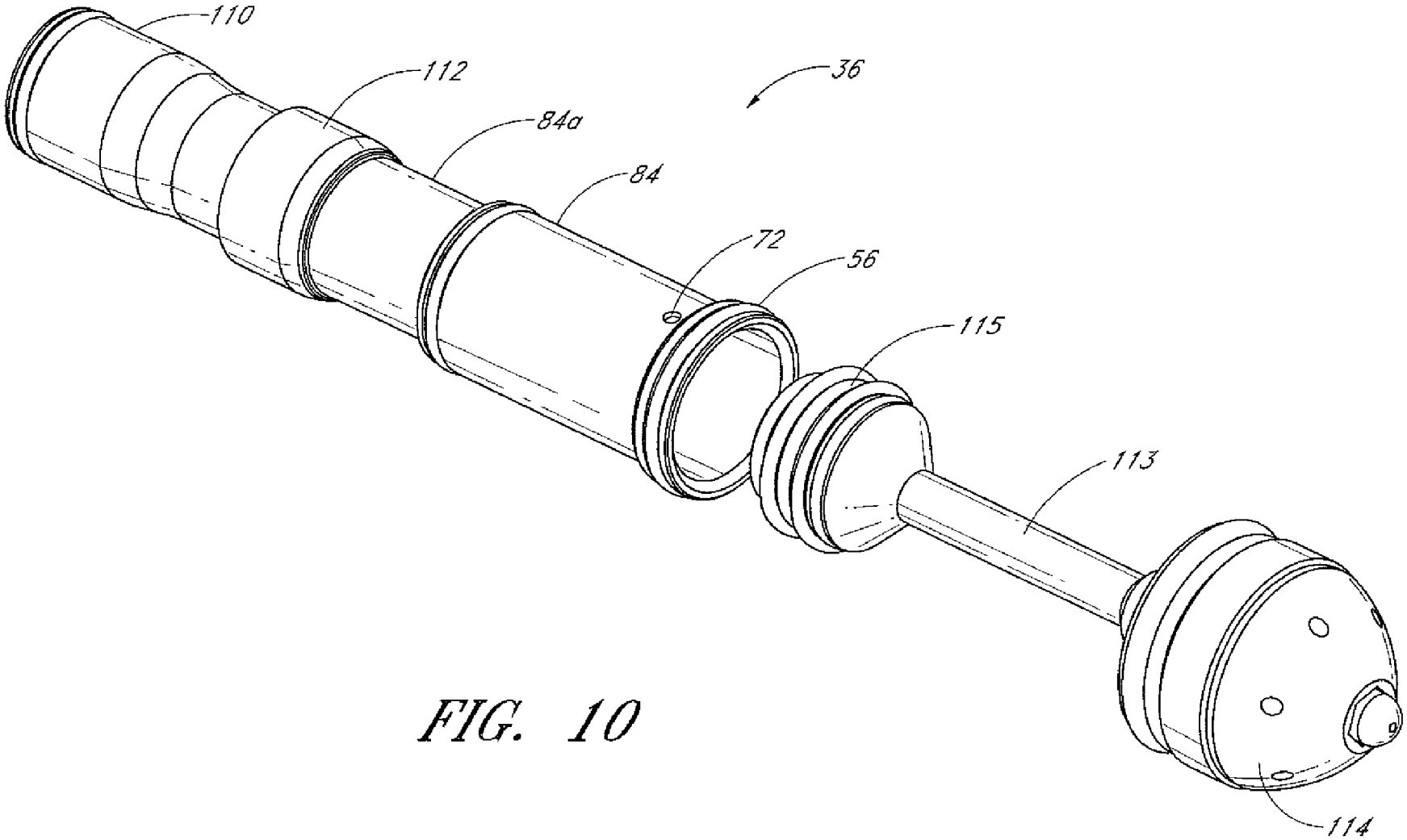
FIG. 10 is a perspective view of the sleeve from FIG. 8 and shows a piston axially aligned with a main cylinder of the sleeve.
Figure 11:
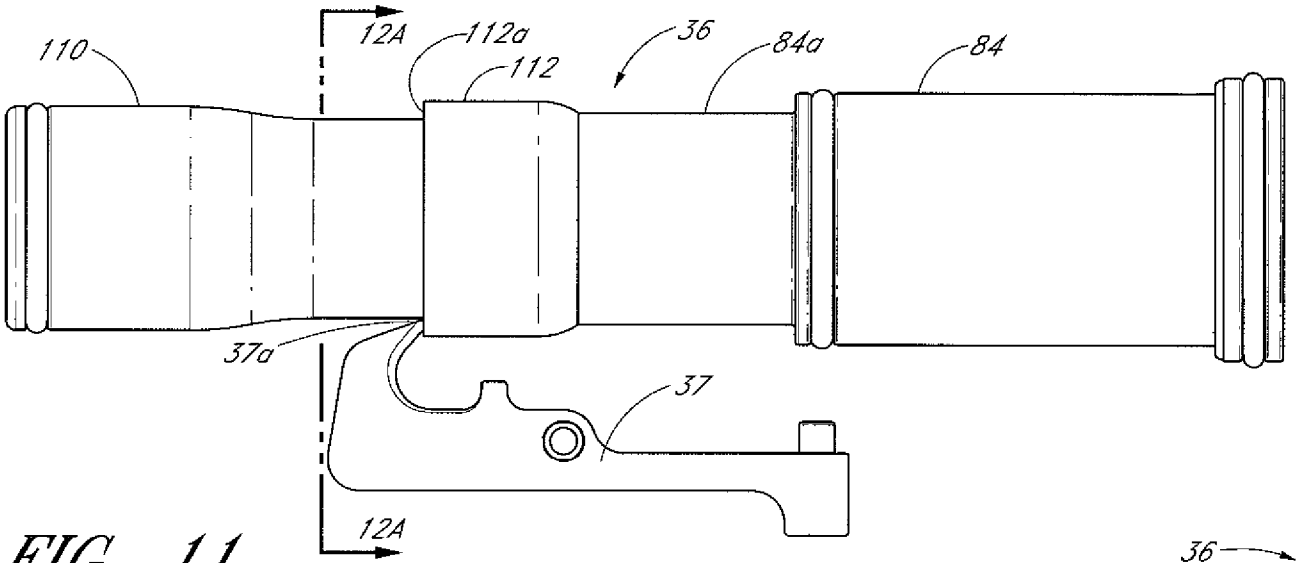
FIG. 11 is a side view of the sleeve from FIG. 10 in a loading position and showing a sear trip in contact with a collar of the sleeve.
Figure 14:
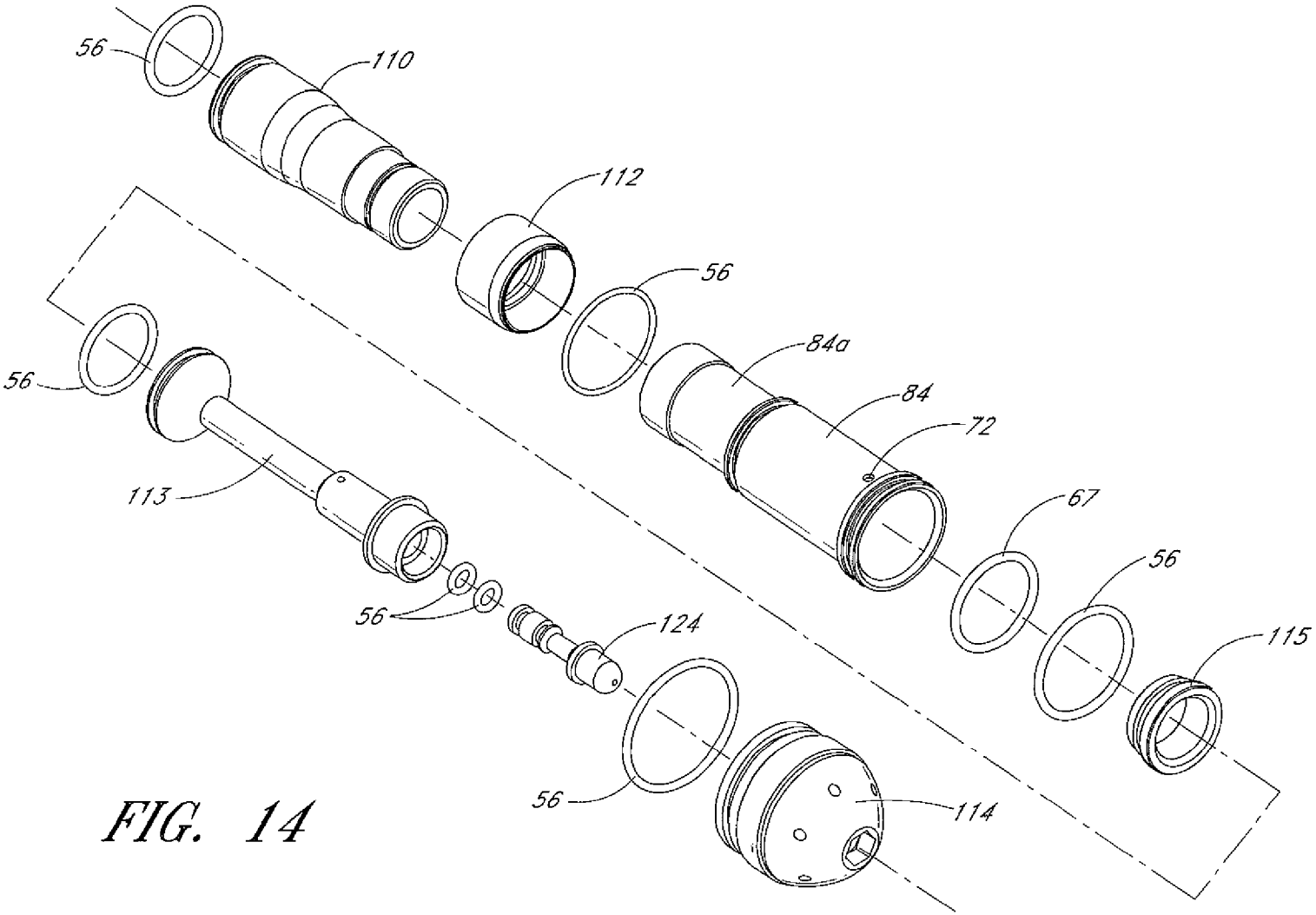
FIG. 14 is an exploded perspective view of the sleeve and piston from FIG. 10.

With reference to FIGS. 10-12B, and 14 in particular, the components comprising the sleeve 36 will now be described in greater detail. FIG. 10 is a perspective view of the sleeve 36 from FIG. 8 and shows a piston 113 axially aligned with a main cylinder 84 of the sleeve 36. FIG. 11 is a side view of the sleeve 36 from FIG. 10 in a loading position and shows the sear member 37 in contact with the collar 112 of the sleeve 36. FIG. 14 is an exploded perspective view of the sleeve 36 and piston 113 from FIG. 10.

In the illustrated embodiments, the sleeve 36 includes a main cylinder 84, a fore cylinder 110, an insert 115, and a collar 112. However, the sleeve 36 is not so limited and may comprise more or less components that will still permit the sleeve 36 to reciprocate relative to the cavity 37. One or more of the components may be integrally machined or separately machined before assembly. For example, the sleeve 36 can be formed from a single, integral member. One or more components of the sleeve 36 may be integral with the body 26 and still perform the required function.

The sleeve 36 may be assembled by the following process. Of course more or less steps may be performed or the steps may be performed in a different order than is described without deviating from the scope of the invention. The main cylinder 84 may be threadably attached or snap fit to the fore cylinder 110 such that a portion of the inner surface of the main cylinder 84 threadably engages a portion of the outer surface of the fore cylinder 110. The insert 115 may be threadably inserted or snap fit into the inside of the main cylinder 84 to buffer the impact between the sleeve 36 and the piston 113 when the sleeve 36 slides in the aft direction. The collar 112 is threadably attached to the outside surface of the main cylinder 84.

Figure 13A:
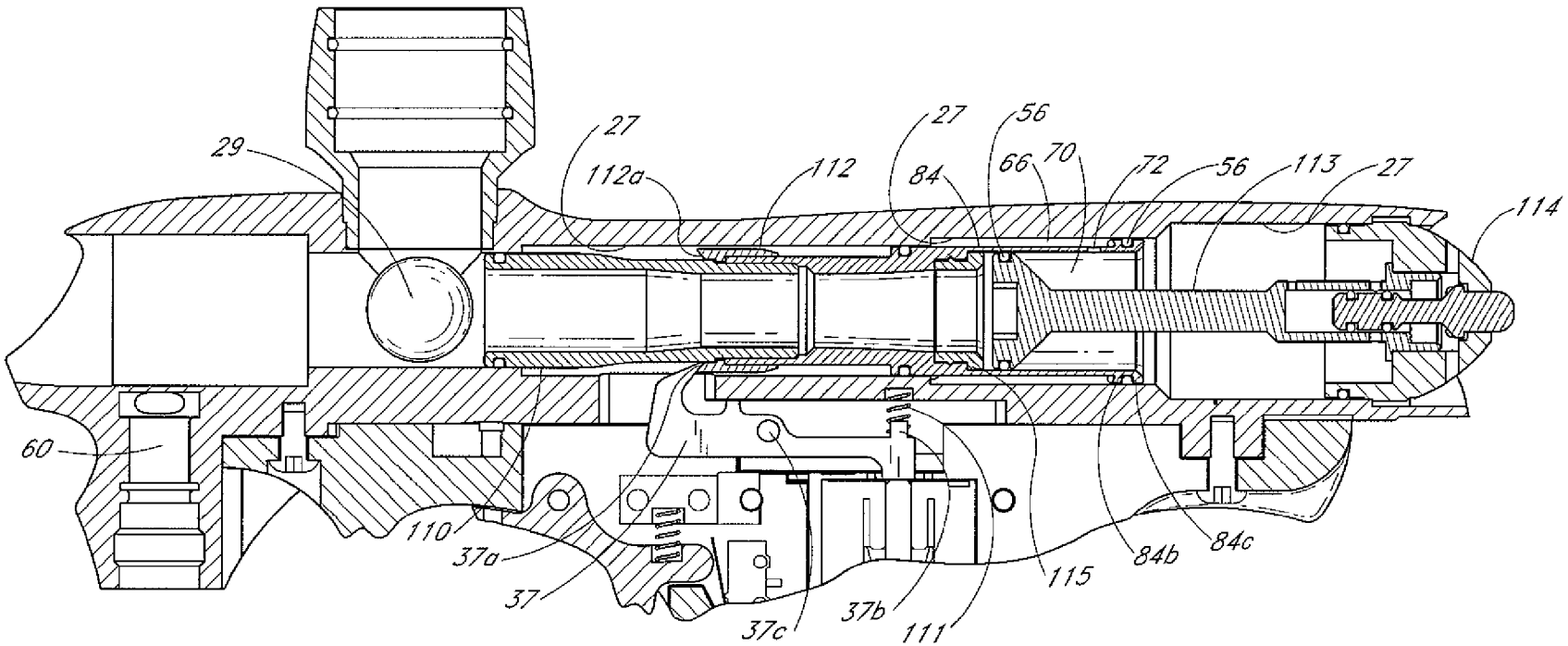
FIG. 13A is a partial cross-section through the center of the pneumatic paintball marker of FIG. 1 with the sleeve in the loading position.

As is most clearly shown in FIGS. 11 and 13A-13E, the collar 112 defines a fore surface 112*a*. As is illustrated in FIG. 13A, the fore surface 112*a* is angled relative to the longitudinal axis of the sleeve 36. Preferably, the angle of the fore surface 112*a* generally matches a fore tip 37*a* of the sear member 37. The fore surface 112*a* may have a generally conical shape. For example, the surface may be angled between approximately 30°-50° relative to a plane that is perpendicular to the centerline axis of the collar 112. Of course the fore surface 112*a* need not be angled. The fore surface 112*a* need not extend around the entire circumference of the sleeve 36 and need only extend in the region of the sear member 37.

When the sear member 37 is in the locked position, the surface of the fore tip 37*a* that contacts the fore surface 112*a* defines a plane that approximately matches the angle defining the fore surface 112*a* of the collar 112. The surface of the fore tip 37*a* that contacts the fore surface 112*a* is preferably configured so as to approximately complement and abut against the fore surface 112*a* when the sear member 37 is in the locked position.

In another embodiment, the collar 112 defines a fore surface 112*a* that is preferably conical and angled between approximately 15°-30°, or between approximately 50°-70° relative to a plane that is perpendicular to the centerline axis of the collar 112.

In another embodiment, the angle of the fore surface 112*a* and the corresponding fore tip 37*a* is defined based on a distance between a pivot axis 37*c* of the sear member 37 and the collar 112. More specifically, a circle having a radius that corresponds to the distance between the pivot axis 37*c* and a point at the intersection of the fore surface 112*a* and the outer surface of the collar 112 is determined. The angle of the fore surface 112 and the fore trip 37*a* is defined by a tangent to the circle at the intersection point. Such a design results in the sear member 37 being unbiased towards or away from the sleeve 36.

The inclined surface of the fore surface 112*a* and matching fore tip 112*a* reduces the likelihood that the sear member 37 will inadvertent release from the collar 112 or will increase the force required to release the sear member 37 from the collar 112.

In another embodiment, the surface of the fore tip 37*a* that contacts the fore surface 112*a* is as previously described except that the surface is approximately convex instead of approximately planar.

The fore surface 112*a* provides an abutment surface for the sear member 37 to engage to inhibit the forward motion of the sleeve 36 while the sear member 37 is in the loading or locked position. The loading or locked position is defined as the position of the sear member 37 when the fore tip 37*a* of the sear member 37 is overlapping the fore surface 112*a* of the collar 112. In this locked position, the forward movement of the sleeve 36 is inhibited by the sear member 37.

Figure 12B:
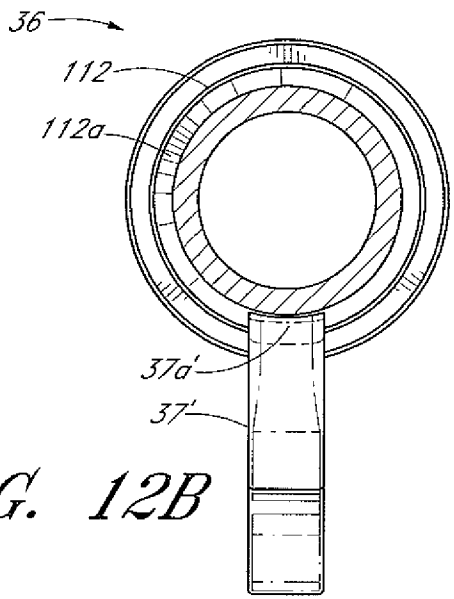
FIG. 12B is a cross-section view through the sleeve taken along lines 12A-12A from FIG. 11 and showing another embodiment of a sear trip that has a tip contoured in a radial direction.
Figure 12A:
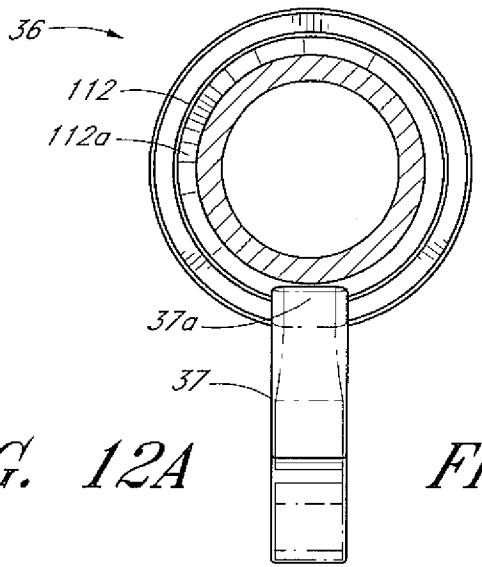
FIG. 12A is a cross-section view through the sleeve taken along lines 12A-12A from FIG. 11 and showing the sear trip in contact with the collar.

FIG. 12A is a cross-section view through the sleeve 36 taken along lines 12A-12A from FIG. 11 and showing the sear member 37 in contact with the collar 112. As is illustrated in FIG. 12A, the top profile of the fore tip 112*a* of the sear trip 112 can be flat.

FIG. 12B is a cross-section view through the sleeve 36 taken along lines 12A-12A from FIG. 11 and showing another embodiment of a sear member 37' that has a tip 37*a*' contoured in a radial direction. In FIG. 12B, the fore tip 37*a*' of the sear member 37' defines a curvature that matches the curvature of the fore portion 84*a* of the main cylinder 84. The surface area overlap is increased without increasing the distance the center of the fore tip 37*a*' extends towards the sleeve 36.

Figure 13B:
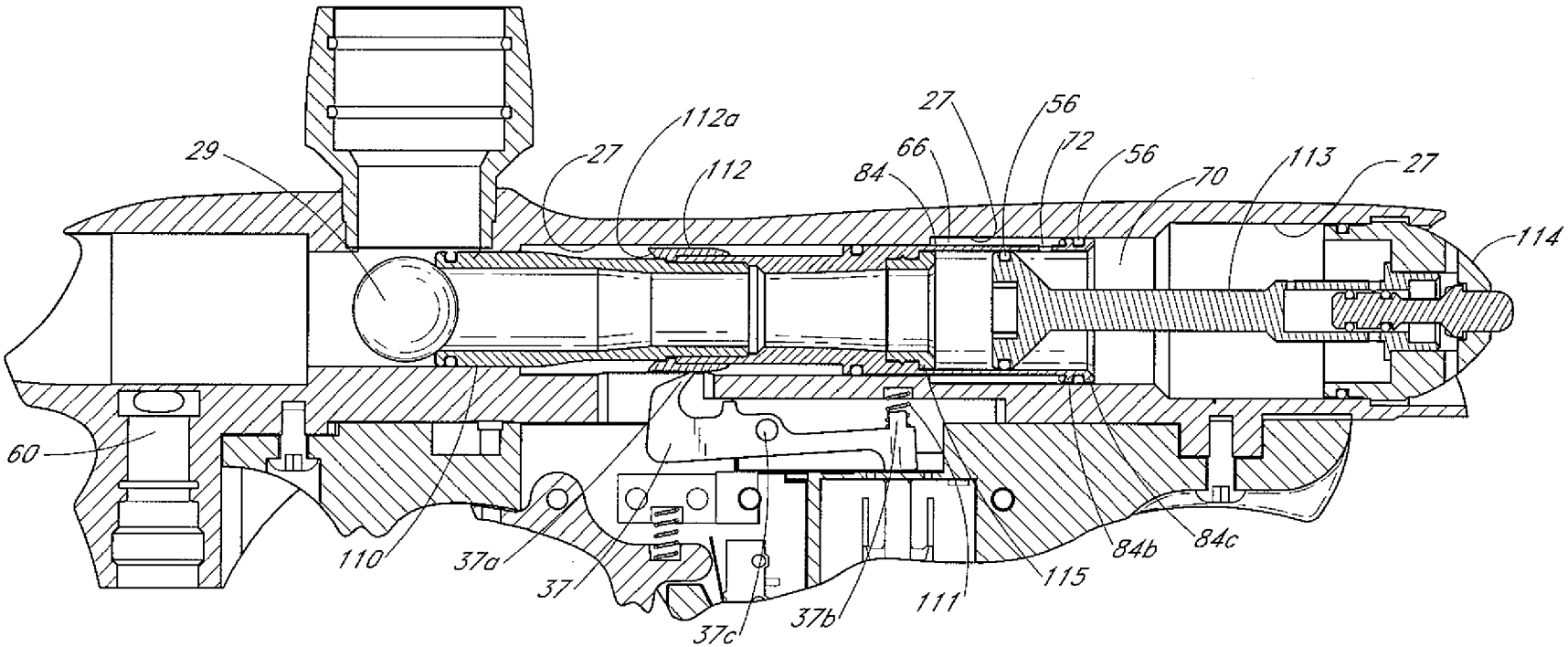
FIG. 13B is a partial cross-section through the center of the pneumatic paintball marker of FIG. 1 with the sleeve slightly forward from the loading position.
Figure 13C:
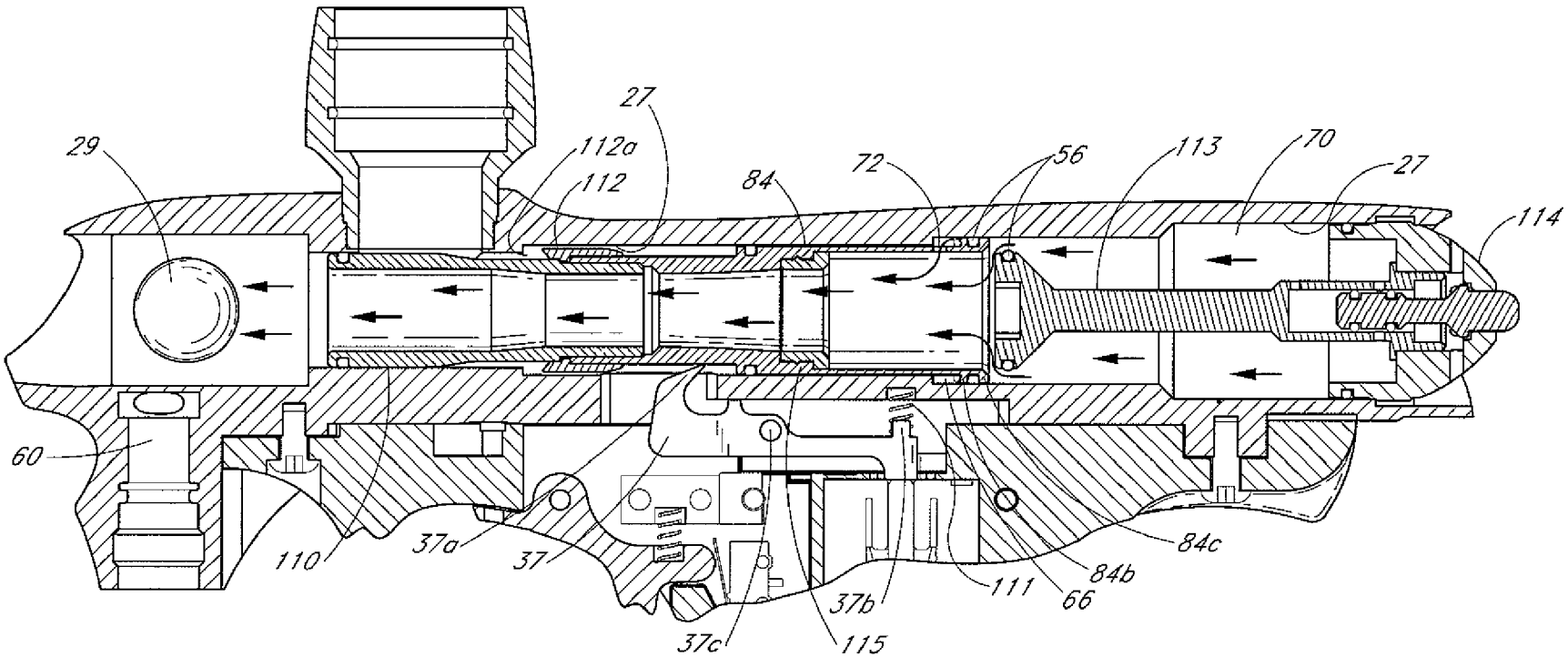
FIG. 13C is a partial cross-section through the center of the pneumatic paintball marker of FIG. 1 with the sleeve further forward from the loading position than is illustrated in FIG. 13B but not in the fully forward position.
Figure 13D:
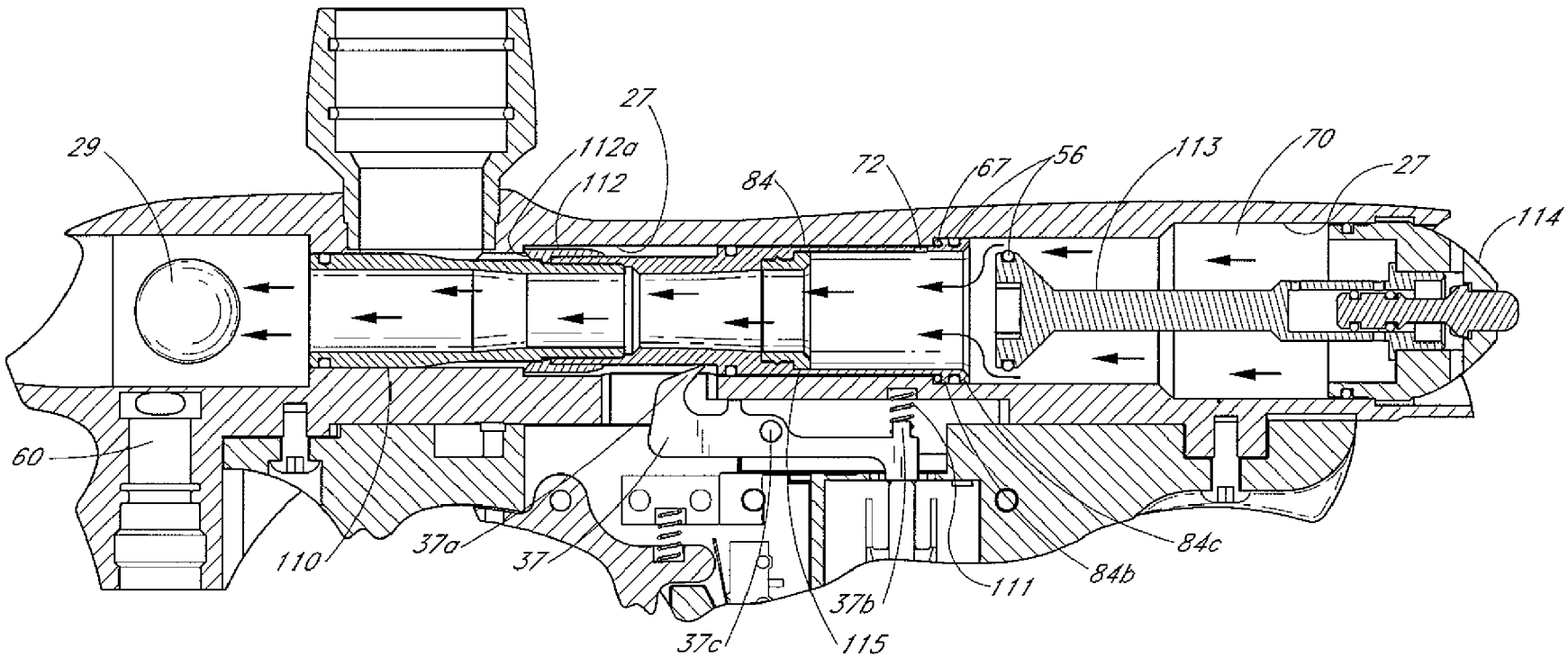
FIG. 13D is a partial cross-section through the center of the pneumatic paintball marker of FIG. 1 with the sleeve in a fully forward position.
Figure 13E:
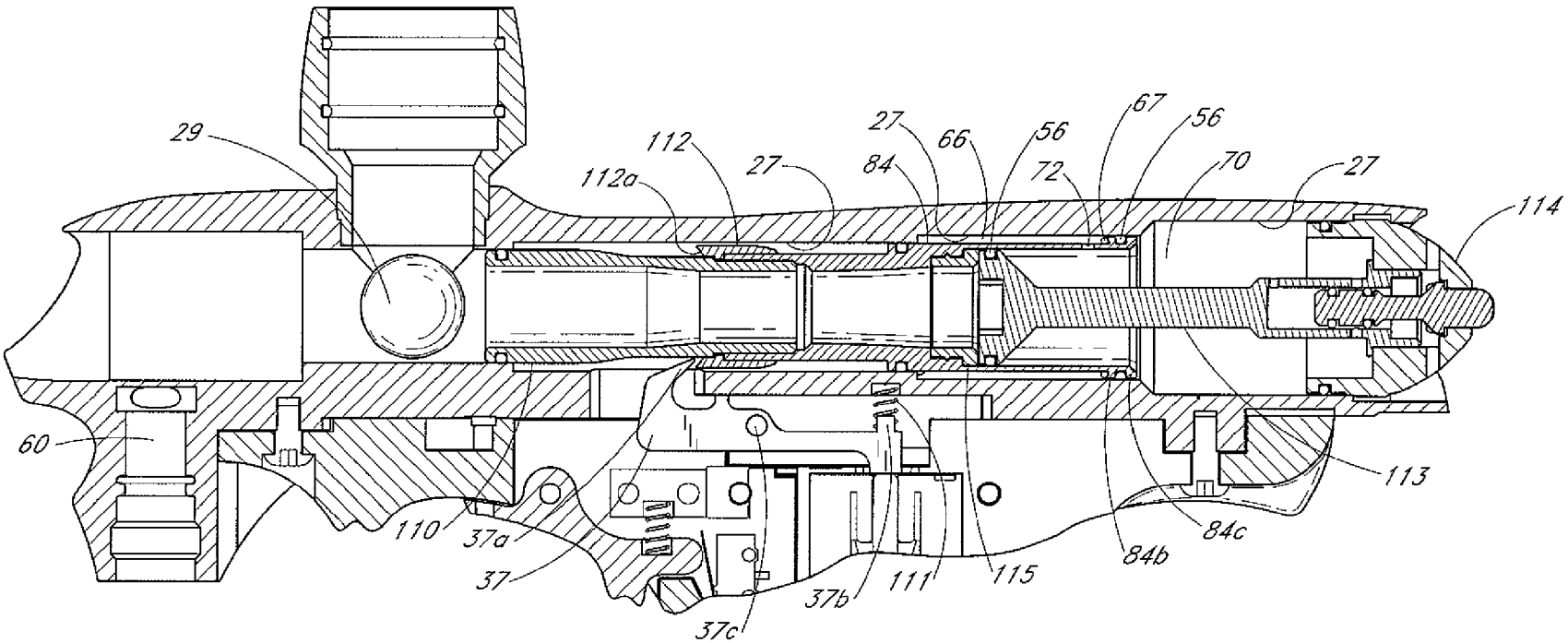
FIG. 13E is a partial cross-section through the center of the pneumatic paintball marker of FIG. 1 with the sleeve in an aft position where gas from the first air chamber is beginning to pressurize the second air chamber.

Movement of the sleeve 36 is most clearly illustrated in FIGS. 13A-13E. FIG. 13A is a partial cross-section through the center of the pneumatic paintball marker of FIG. 1 with the sleeve 36 in the loading position. FIG. 13B is a partial cross-section through the center of the pneumatic paintball marker 20 with the sleeve 36 slightly forward from the loading position. FIG. 13C is a partial cross-section through the center of the pneumatic paintball marker 20 with the sleeve 36 further forward from the loading position than is illustrated in FIG. 13B but not in the fully forward position. FIG. 13D is a partial cross-section through the center of the pneumatic paintball marker 20 of FIG. 1 with the sleeve 37 in a fully forward position. FIG. 13E is a partial cross-section through the center of the pneumatic paintball marker 20 with the sleeve 36 in an aft position where gas from a first air chamber 66 is beginning to pressurize a second air chamber 70.

In the embodiment illustrated in FIG. 1, the sleeve 36 reciprocates between a loading or locked position as illustrated in FIG. 13A, to a forward or open position as illustrated in FIG. 13D, to a rearward position as illustrated in FIG. 13E, and finally back to the loading position. The gas pathway between the in-line regulator 30 and the first chamber 66 is described below.

Figure 16:
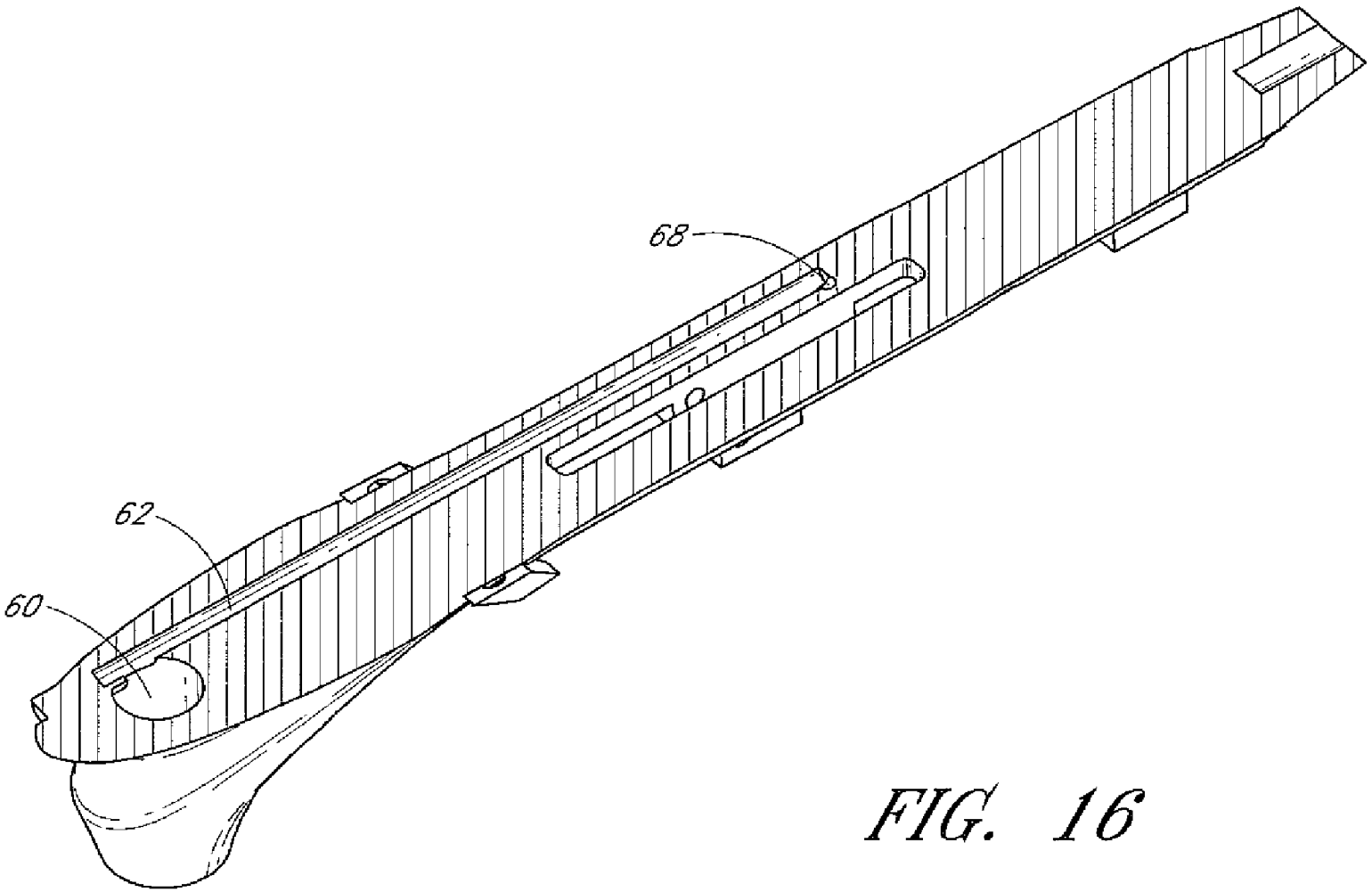
FIG. 16 is a section view of the pneumatic paintball marker taken along line 16-16 in FIG. 3 and showing a longitudinal air passage offset from the longitudinal axis or centerline of the marker.
Figure 17:
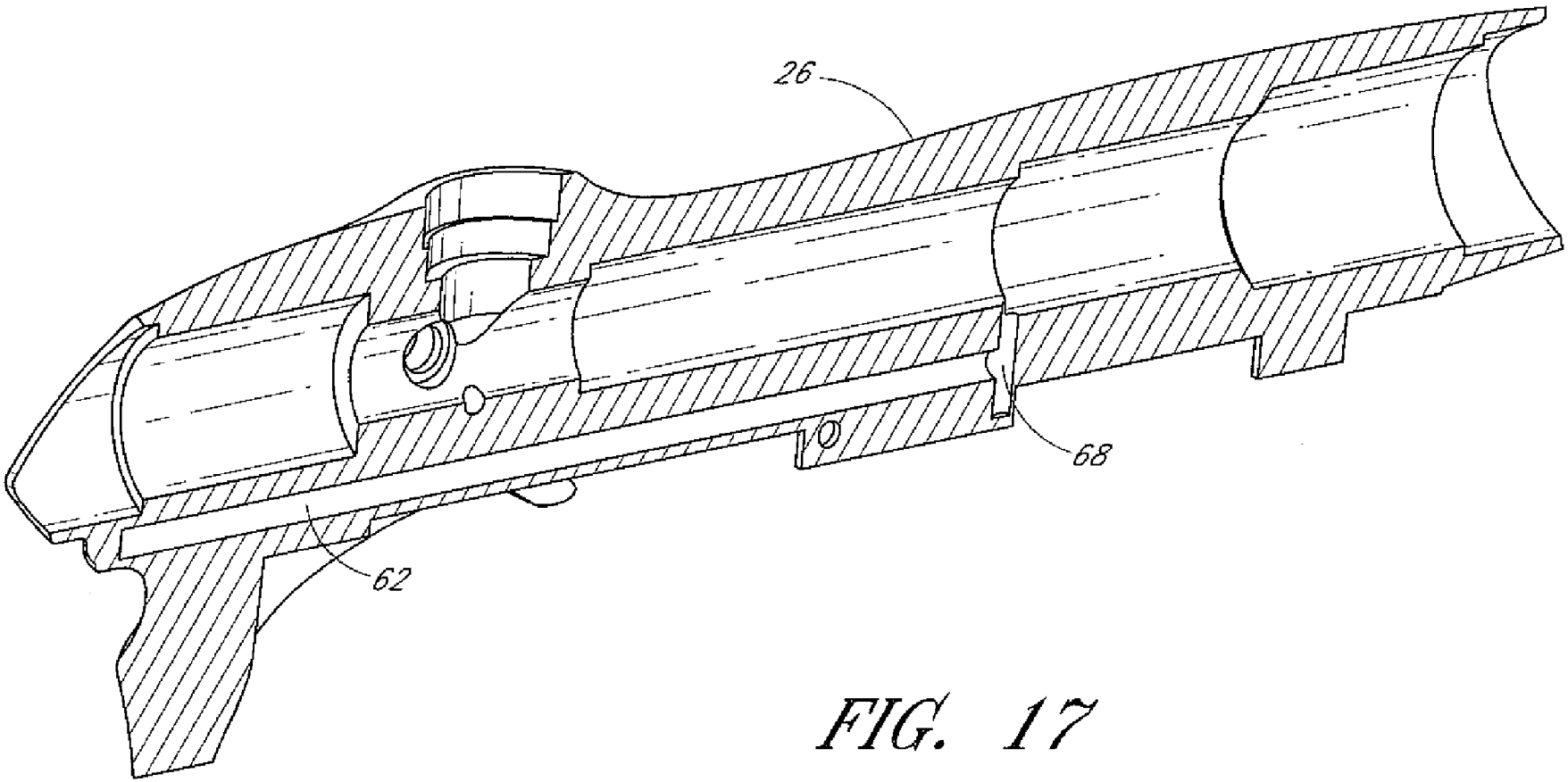
FIG. 17 is a section view of the pneumatic paintball marker taken along line 17-17 in FIG. 3 and showing the longitudinal air passage.

FIG. 16 is a section view of the pneumatic paintball marker 20 taken along line 16-16 in FIG. 3 and showing a longitudinal air passage 62 offset from the longitudinal axis or centerline of the marker 20. FIG. 17 is a section view of the pneumatic paintball marker 20 taken along line 17-17 in FIG. 3 and showing the longitudinal air passage 62. The longitudinal air passage 62 routes air from the in-line regulator 30 along the length of the body 26. The longitudinal air passage 62 extends rearward along the length of the body 26 between the inlet passage 60 and the transfer passage 68.

After the longitudinal air passage 62 and the transfer passage 68 are machined, the openings to the longitudinal air passage 62 through the front of the marker 20 and the transfer passage 68 are sealed, as illustrated most clearly in FIGS. 3, 16, and 17. The passages 62, 68 can be sealed by, for example, inserting a screw in the ends thereof. The screw inhibits air within the longitudinal air passage 62 and the transfer passage 68 from leaking to the outside atmosphere.

The supply of air is routed to a first air chamber 66 via a transfer passage 68. As illustrated most clearly in FIGS. 13A-13E, the first air chamber 66 is defined as the annular space between the outside surface of the main cylinder 84 and the inside surface of the cylindrical opening 27. Of course the first air chamber 66 is not limited by the illustrated embodiment and may have other shapes or sizes while still performing at least the function of translating the sleeve 36 in at least one direction when pressurized. In the illustrated embodiment, the first air chamber 66 translates the sleeve 36 in the rearward direction during marker 20 operation.

In the illustrated embodiment, an annular seal 56 between a first flange 84*b* and a second flange 84*c* on the main cylinder 84 inhibits the air from leaking into the second air chamber 70. A wide variety of sizes and shapes of conventional o-rings have been used throughout the pneumatic paintball marker 20. The function of the seals is to at least inhibit, if not prevent, flow through an adjacent gap or space, when configured as a bumper 67 limit travel of the sleeve 36, and/or reduce surface friction between adjacent surfaces. To simplify the description, the o-rings are all given the identifying numeral 56. Of course the marker 20 may include more, less, or no seals and still operate in its intended manner. For example, machining tolerances of two adjacent surfaces can be selected to perform the same function of the seal or a lip, or a protrusion or ridge may be incorporated to close or reduce the size of a gap or space.

The supply of air is then routed to a second air chamber 70. The second air chamber 70 is defined generally as the space confined by the walls of the opening 27, the inner surface of the main cylinder 84, the rear cap 114, and the piston 113. Of course the second air chamber 70 is not limited by the illustrated embodiment and may have other shapes or sizes while still performing at least the function of translating the sleeve 36 in at least one direction when pressurized. In the illustrated embodiment, the second air chamber 70 translates the sleeve 36 in the forward direction during marker 20 operation.

The air flows through at least one opening or orifice 72 between the first air chamber 66 and the second air chamber 70. While the illustrated embodiment has a single orifice 72, the invention is not so limited and may include multiple orifices, openings, slots, slits, or any other shaped opening. The orifice 72 is illustrated as being disposed in the main cylinder 84 of the sleeve 36. Of course the orifice 72 or an additional orifice may be disposed in the same or different portion of the sleeve 36 and still have air pass through the orifice 72 between the first air chamber 66 and the second air chamber 70. The at least one orifice 72 is sized and shaped to slow or inhibit flow between the first air chamber 66 and the second air chamber 70.

The marker 20 may include one or more additional chambers, manifolds, or orifices disposed in the flow path between the first air chamber 66 and the second air chamber 70, upstream of the first air chamber 66, and/or downstream of the second air chamber 70 and still fall within the scope of the invention. Further, the functions of the first air chamber 66 and the second air chamber 70 can be reversed whereby the first air chamber 66 translates the sleeve 36 in a forward direction and the second air chamber 70 translates the sleeve 36 in the rearward direction.

The piston 113 is threadably attached or otherwise fixed to the rear cap 114 and need not rotate or translate. Significant aspects of these features and the sequence described above will be described in greater detail below.

When the firing sequence is initiated by releasing the sear member 37, the sleeve 36 translates a sufficient distance toward the fore portion of the marker 20 to permit the compressed air in the second air chamber 70 to flow past the piston 113, flow through the inside of the sleeve 36, and flow out through the barrel 22, thus propelling a marker or paintball out through the barrel 22.

Figure 9:
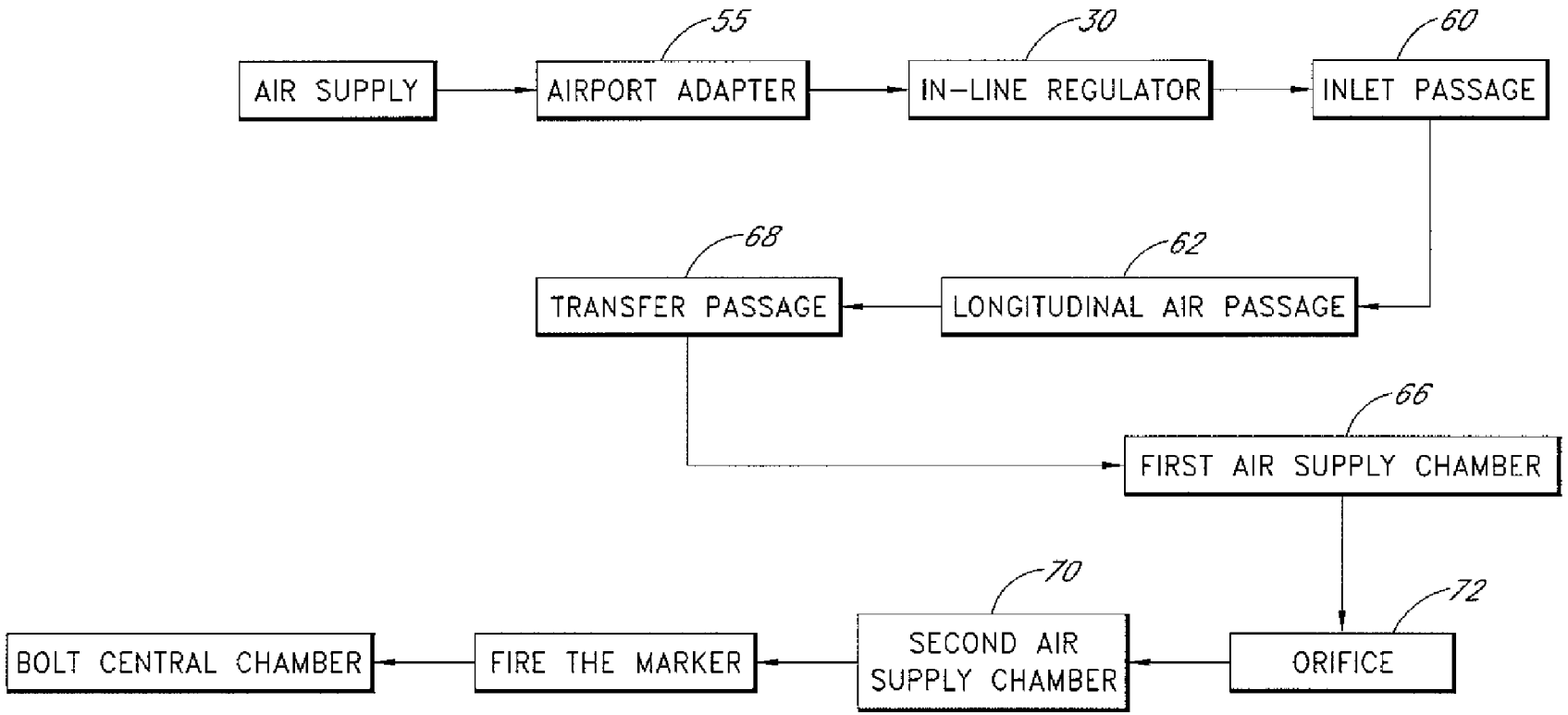
FIG. 9 is a block diagram describing the air movement through the pneumatic paintball marker.

FIG. 9 is a block diagram describing the air movement through the pneumatic paintball marker 20. With reference to FIG. 9 and the illustrations in FIGS. 13A-13E and 17, the operation of the pneumatic paintball marker 20 will now be described. Air is supplied to the sleeve 36 at least at one location along the longitudinal axis of the sleeve 36, i.e., through the transfer passage 68. The transfer passage 68 supplies air to the first air chamber 66. As the first air chamber 66 is filled, the air begins to fill the second air chamber 70 through the orifice 72 in the main cylinder 84. Given enough time, the pressures within both the first and second air chambers 66, 70 can be substantially equal to one another. During rapid firing of the marker 20, the pressures in the first air chamber 66 and the second air chamber 70 may not reach the same pressure.

The main cylinder 84 is configured such that the aggregate projected surface area of the vertical and inclined surfaces of the second flange 84*c* that are exposed to the air within the second air chamber 70 is greater than the aggregate projected surface area of the vertical and inclined surfaces, if any, that are exposed to the air within the first air chamber 66. In other words, the second flange and the vertical and inclined surfaces, if any, that are exposed to the air within the first air chamber 66 are sized (i.e., configured) such that, when the pressure within the first and second air chambers 66, 70 are equal to one another, the force exerted by the air within the second air chamber 70 on the sleeve 36 will preferably be greater than the force exerted by the air within the first air chamber 66 on the sleeve 36, such that the sleeve 36 will experience a force that will tend to push the sleeve 36 forward.

When the sleeve 36 is caused to move forward to the locked position, as illustrated in FIG. 13A, the marker 20 is then ready to be fired. As stated above, in this position, the pressure of the air within the second air chamber 70 on the vertical and inclined surfaces of the second flange 84*c* that are on the inside of the main cylinder 84 exerts a force on the sleeve 36 in the fore direction that is greater than the force exerted on the sleeve 36 in the aft direction. Further, in this position, the piston 113 and the annular seal 56 around the circumference of the fore tip of the piston 113 prevent the air within the second air chamber from flowing out of the second air chamber 70 and through the inner opening of the sleeve 36.

To release the paintball 29 from the pneumatic marker 20, the user squeezes the trigger 38, activating the micro switch 126. When the micro switch is actuated, an electronic signal actuates the actuator 78, which in turn actuates the sear member 37 by applying an upward, axial force on the aft portion 37*b* of the sear member 37. The upward, axial force exerted on the aft portion 37*b* of the sear member 37 causes the sear member 37 to rotate about the axis defined through the axial center of the pin 37*c*, pivoting the fore tip 37*a* of the sear member 37 in a downward direction. As the fore tip 37*a* of the sear member 37 pivots in the downward direction, the sear member 37 eventually disengages from the collar 112, releasing the sleeve 36. As mentioned above, the pressure of the air within the second air chamber 70 on the vertical and inclined surfaces of the second flange 84*c* that are on the inside of the main cylinder 84 propels the sleeve 36 in the fore direction. FIG. 13B illustrates the position of the sear member 37 and sleeve 36 just after the sear member 37 has been actuated. At this precise moment in the sequence, the sleeve 36 has moved slightly toward the fore portion of the body 26, but the sleeve 36 has not moved far enough to allow the air occupying the second air chamber 70 to bypass the piston 113.

Pressure within the second air chamber 70 continues to force the sleeve 36 forward until the sleeve 36 has reached the fully forward position, as illustrated in FIG. 13D. The sleeve 36 may comprise a bumper surface or member 67. The bumper 67 is disposed so as to limit the maximum travel of the sleeve 36 in the forward direction and inhibit the metal sleeve 36 from slamming into the metal housing 26. In the illustrated embodiment, the bumper 67 is disposed forward of the first flange 84*b*. Of course the bumper 67 may be located at any location along the sleeve 36 or opening 27 and still provide a buffer between the sleeve 36 and the housing 26. For example, the bumper 67 may be located between the front of the collar 112 and the housing 26.

The bumper 67 is preferably made from plastic, rubber, or the like, to reduce or eliminate impact damage that may otherwise result from the sleeve 36 sliding forward into a restriction in the opening 27 or slamming into the housing 26. Additionally, as illustrated in FIG. 13D, the collar 112 alone or in combination with the bumper 67 may prevent the sleeve 36 from translating too far forward in the opening 27.

After the sleeve 36 passes the position where the piston 113 and seal 56 at the fore portion of the piston 113 no longer inhibit air from passing through the forward, inner portion of the sleeve 36, the air within the second air chamber 70 exits through the sleeve 36, propelling the paintball out of the barrel 22. The flow of pressurized air from the second air chamber 70 through the sleeve 36 is represented by arrows in FIGS. 13C and 13D. In the fully forward position, as is illustrated in FIG. 13D, the increased air pressure within the second air chamber 70 is being exhausted, moving the pressure within the first air chamber 66 and second air chamber 70 toward ambient levels.

Note that, as the sleeve 36 moves forward, i.e., from the loading position illustrated in FIG. 13A to the fully forward position illustrated in FIG. 13D, the volume of air space within the first air chamber 66 decreases. The orifice 72 provides an outlet for the air within the first air chamber 66 and, accordingly, inhibits air within the first air chamber 66 from increasing in pressure. Increasing the pressure in the first chamber 66 may impede the forward motion of the sleeve 36 as the volume of air space within the first air chamber 66 decreases.

In particular, when the sleeve 36 is positioned such that the orifice 72 is aft of the seal 56 located at the fore portion of the piston 113 (as illustrated in FIG. 13B), air within the first air chamber 66 is released to the second air chamber 76 through the orifice 72 as the volume of air space within the first air chamber 66 decreases.

Similarly, when the sleeve 36 is positioned near the fully forward position, i.e., such that at least a portion of the orifice 72 is forward of the seal 56 located at the fore portion of the piston 113 (as illustrated in FIG. 13C), air within the first air chamber 66 is released into the interior volume of the sleeve 36 through the orifice 72 as the volume of air space within the first air chamber 66 decreases. An arrow in FIG. 13C emanating from the orifice 72 represents the flow of air from the first air chamber 66 into the interior volume of the sleeve 36 through the orifice 72 as the volume of air space within the first air chamber 66 decreases.

This arrangement inhibits the air within the first air chamber 66 from impeding the forward motion of the sleeve 36 as the volume of air space within the first air chamber 66 decreases and, consequently, allows the sleeve 36 to remain in the forward position for a slightly longer period of time, allowing more time for the air to flow out of the second air chamber 70.

With the air pressure within the first and second air chambers 66, 70 near ambient levels, air from the air supply once again travels through the inlet passage 60, longitudinal air passage 62, transfer passage 68, and into the first air chamber 66, as described above. As illustrated in FIG. 13D, when the sleeve 36 is in the fully forward position, the volume of space within the first air chamber 66 is very small. However, as air begins to fill the first air chamber 66, the pressure of the first air chamber 66 relative to the second air chamber 70 increases. The relatively higher air pressure within the first air chamber 66 at this stage causes a force to be exerted on the first flange 84*b*, pushing the sleeve 36 toward the rear cap 114.

During operation of the marker 20 when the marker is fired repeatedly, the pressure within the first air chamber 66 may not reach the same magnitude as the pressure within the second air chamber 70 because, as paintballs are repeatedly fired, air may be more or less constantly supplied to the first air chamber 66 so that paintballs are repeatedly fired from the marker 20.

While the first air chamber 66 is being filled, a certain volume of air is also entering the second air chamber 70 through the orifice 72. Thus, the size and location of the orifice 72 is determined so as to regulate the amount of air flowing from the first air chamber 66 into the second air chamber 70. For example, air flowing quickly into the second air chamber 70 increases the fire rate of the marker 20. However, if the air fills the second air chamber 70 too quickly, the first air chamber 66 may not reach the relative pressure differential with respect to the second air chamber 70 that is necessary to push the sleeve 36 to the rear position.

To overcome this concern, while the configuration of the transfer passage 68 and orifice 72 can vary widely, the marker 20 is preferably configured such that the volumetric flow rate of air through the transfer passage 68 is greater than the volumetric flow rate of air through the orifice 72 during the operation of the marker 20. For example, the transfer passage 68 can be configured to be a substantially cylindrical through hole with a diameter that is approximately 0.15 in. The orifice 72 can be a substantially cylindrical through hole with a diameter that is approximately 0.10 in. The orifice 72 may be located on the main cylinder 84 such that, when the sleeve 36 is in the fully forward position (as illustrated in FIG. 13D), the air filling the first air chamber 66 is substantially inhibited from flowing through the orifice 72 by an inner wall of the opening 27. This allows the first air chamber 66 to exceed the threshold magnitude of pressure relative to the second air chamber 70 and facilitate retraction of the sleeve 36 to the fully aft position.

In other embodiments, the transfer passage 68 may have a circular cross-section and a diameter that is less than approximately 0.15 in., or between approximately 0.15 in. and approximately 0.20 in., or between approximately 0.20 in. and approximately 0.25 in., or between approximately 0.25 in. and approximately 0.30 in. Similarly, in other embodiments, the orifice 72 may have a circular cross-section and a diameter that is less than approximately 0.10 in., or between approximately 0.10 in. and approximately 0.15 in., or between approximately 0.15 in. and approximately 0.2 in., or between approximately 0.20 in. and approximately 0.25 in. In yet other embodiments, either the transfer passage 68 or the orifice 72 can have any shape for its cross-section, such as a square, rectangular, or otherwise. In other embodiments, the orifice 72 may comprise multiple through holes penetrating the wall of the main cylinder 84 and located at any of a variety of positions.

Figure 15B:
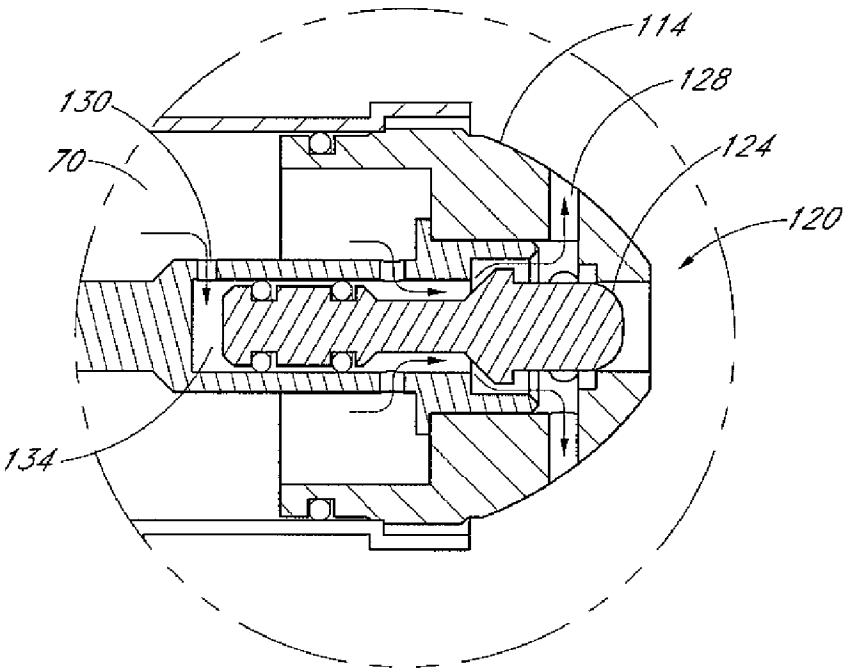
FIG. 15B is an enlarged view of a rear portion of the pneumatic paintball marker from FIG. 8 showing the pressure relief valve in the open position.
Figure 15A:
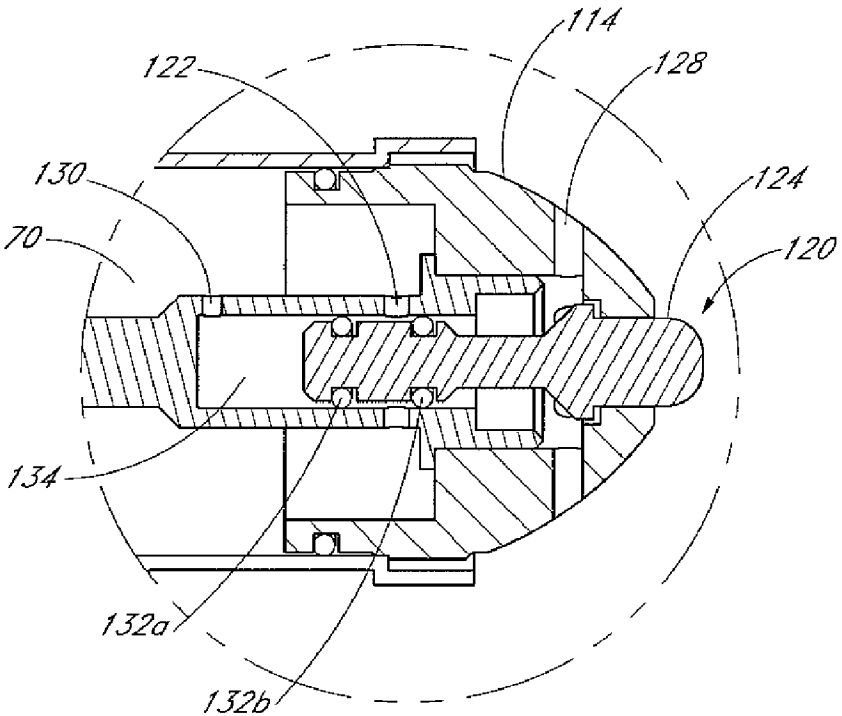
FIG. 15A is an enlarged view of a rear portion of the pneumatic paintball marker from FIG. 8 showing the pressure relief valve in the closed position.

FIG. 15A is an enlarged view of a rear portion of the pneumatic paintball marker 20 from FIG. 8 showing a pressure relief valve 120 in the closed position. FIG. 15B is an enlarged view of a rear portion of the pneumatic paintball marker 20 from FIG. 8 showing the pressure relief valve 120 in the open position. The pressure relief valve 120 provides a means for the user to reduce the pressure of air within the second air chamber 70. This may be needed to properly return the sleeve 36 to the fully aft position illustrated in FIG. 13E. While the configuration of the pressure relief valve 120 can vary widely, the pressure relief valve 120 is preferably configured such that the volumetric flow rate of air through the rear cap 114 is greater than the volumetric flow rate of air through the orifice 72 when the pressure relief valve 120 is depressed.

As such, the pressure relief valve 120 may comprise a pair of seals 132*a*, 132*b* around the outer surface of the valve piston 124. The seals 132*a*, 132*b* prevent air that has entered the valve chamber 134 through either of the ports 122, 130 from flowing out of the rear cap 114. In the closed position, the pressure relief valve 120 and rear cap 114 are substantially sealed such that no air is desirably released therethrough from the second air chamber 70. In the open position, when the pressure relief valve 120 is depressed sufficiently far such that the aft-most seal 132*b* is positioned inboard of the port 122, air is able to flow through the port 122, past the valve piston 124, and out to the ambient air through the end cap ports 128 in the end cap 114. Arrows indicating the flow path of air through the open pressure relief valve 120 are illustrated in FIG. 15B.

Air pressure within the valve chamber 134 exerts a force on the pressure relief valve 120 toward the aft of the marker 20, biasing the pressure relief valve 120 to the closed position. In other embodiments, the pressure relief valve 120 can be configured such that a mechanical or air spring within the valve chamber 134 provides a biasing means to return the valve piston 124 to the closed position. In some of these embodiments, the pressure relief valve 120 may be configured so as to not have a port 130 to the fore of the valve piston 124. Similarly, in some of these embodiments, the pressure relief valve 120 may be configured so as to not have a fore seal 132*a*.

Thus, as stated, in some instances, after the marker 20 has been fired, the second air chamber 70 may fill too quickly such that the sleeve 36 does not fully retract to the aft position. In some of the embodiments described herein, the sleeve 36 may have to fully retract to the aft position in order for the sear member 37 to engage the collar 112. By depressing the pressure relief valve 120 into the rear cap 114, air from the second air chamber 70 is evacuated to the ambient air through the rear cap 114. After a sufficient amount of air has been released from the second air chamber 70, the pressure within the first air chamber 66 will be sufficient to force the sleeve 36 to the fully aft position.

The sleeve 36 may be inhibited from traveling further toward the rear cap 114 by the impact of a front surface of the piston 113 on the insert 115. The insert 115 may be formed from a resilient or other suitable material to reduce the impact force between the sleeve 36 and the piston 113. In other embodiments, a soft, resilient overlay may be added to the fore surface of the piston 113 to reduce the impact force between the sleeve 36 and the piston 113.

In other embodiments, the cylinder 27 may be configured to define protrusions, constrictions, or other suitable features to prevent the sleeve 36 from traveling further toward the rear cap 114. Such protrusions, constrictions, or other suitable features may similarly comprise a resilient or other suitable material to reduce the impact force between the sleeve 36 and the piston 113. As can be seen in FIG. 13E, the sleeve 36 is located sufficiently toward the aft of the cylinder 27 such that the collar 112 has passed beyond the fore tip 37*a* of the sear member 37. In this position, as the second air chamber 70 fills with air, the sleeve 36 will be pushed forward, returning the sleeve 36 to the loading position illustrated in FIG. 13A.

The anti-chop eye system will now be described. The anti-chop eye system inhibits a pneumatic paintball marker from breaking paintballs within the marker which is commonly called, chopping paint. The anti-chop eye system does not allow the marker to fire until a paintball is fully seated in front of the bolt or at least positioned so as to minimize the risk of chopping paint. Certain embodiments of the anti-chop eye system have a transmitting device that sends a beam through the barrel cavity or cylinder 27 to identify the paintball location. A sensing device may be located on the same or opposite side of the barrel cavity from the transmitting device. In certain embodiments the beam crosses the barrel cavity and is sensed by the sensing device when the paintball is unloaded. In certain embodiments the beam is reflected off the paintball and towards the sensing device when the paintball is loaded.

The beam passes through a transmitting surface before entering the breech or barrel cavity. After crossing the barrel cavity or cylinder 27, the beam passes through a receiving or sensing surface. Preferably, the transmitting surface and the receiving surface are disposed relative to the surface of the barrel cavity so as to be automatically wiped or cleaned during operation of the pneumatic paintball marker.

For example, the transmitting and sensing surfaces may be disposed relative to a reciprocating sleeve, or the like, so that, during use of the paintball marker, the reciprocating member removes contaminants or the like from the transmitting and/or sensing surfaces. In certain embodiments, the reciprocating member directly contacts the surfaces of a first lens associated with a transmitter and a second lens associated with a receiver. The transmitter or sending part may be an Infra red light emitting diode (LED). Preferably when the reciprocating member moves past the lenses, contaminants on the surfaces of the lenses are removed. In certain embodiments, the reciprocating member directly contacts the surface of a unitary transmitter and lens and the surface of a unitary receiver and lens. Accordingly, the transmitting surface may be a surface of a separate lens or of the transmitter itself. Similarly, the receiving surface may be a surface of a separate lens or of the receiver itself.

A user can remove the left and right cover plates 34 to access the components comprising the anti-chop eye system if necessary. Instead of being located on both sides of the body 26, the anti-chop eye system may be located on a single side of the body 26. In such an embodiment, a beam of light transmitted from a first side can be reflected back to the same side to indicate that a paintball is properly positioned within the breech prior to firing.

Figure 18:
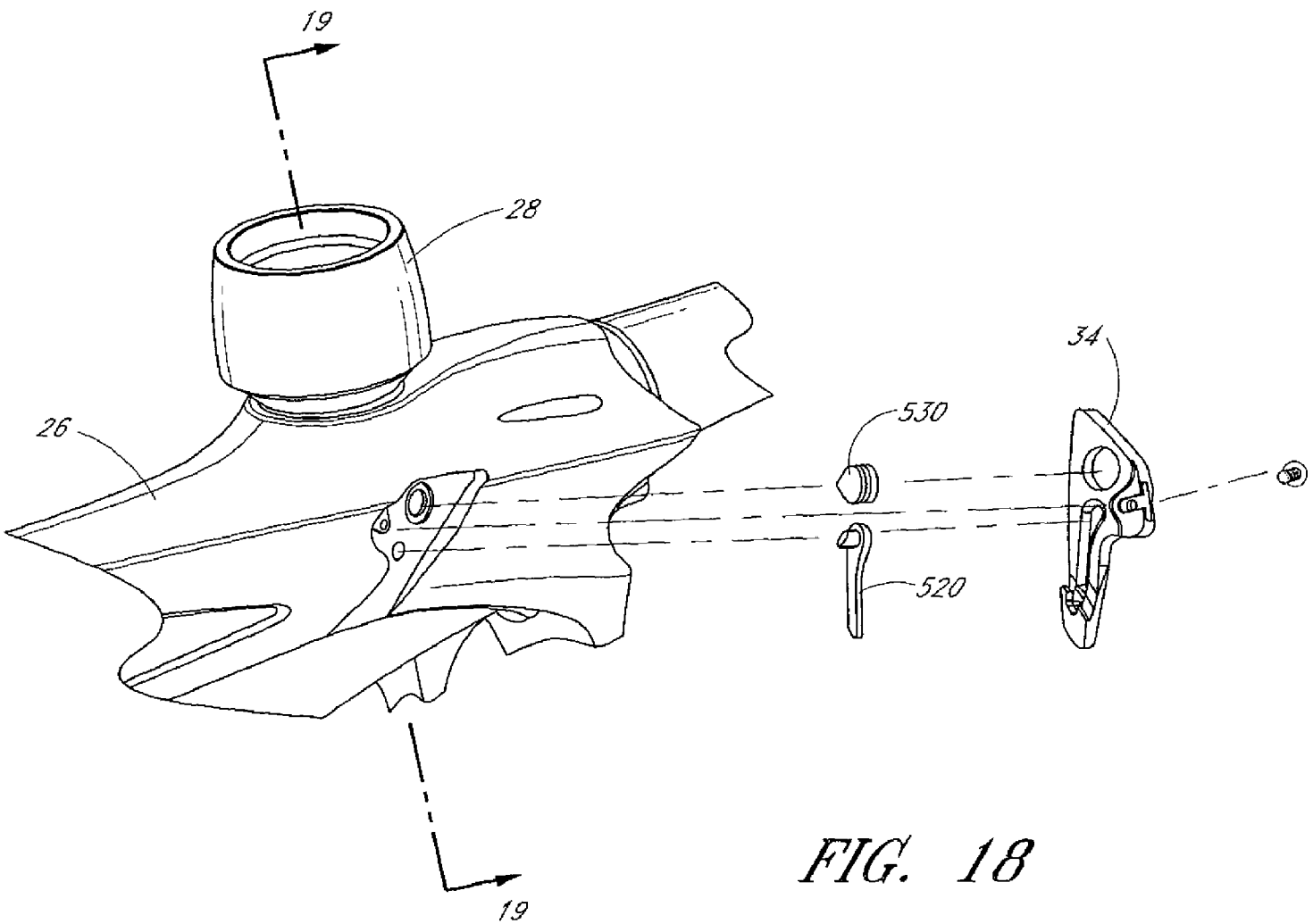
FIG. 18 is an exploded perspective view of exemplary components of an anti-chop eye system that are located under the right cover plate.
Figure 19:
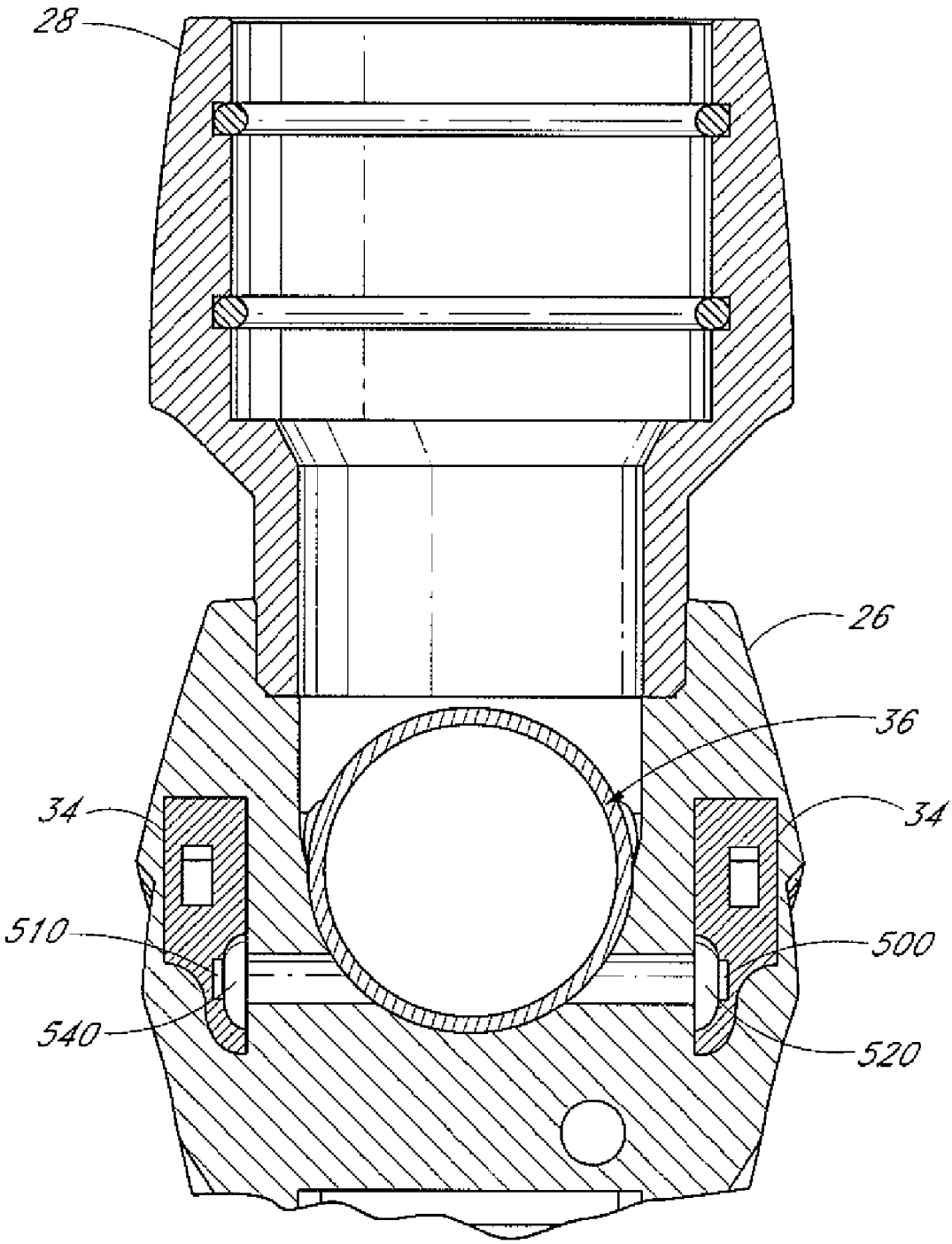
FIG. 19 is a cross-section view of the pneumatic paintball marker of FIG. 1 taken along lines 19-19 in FIG. 18 and shows first and second lenses of the anti-chop eye system disposed on opposite sides of the breech.

FIG. 18 is an exploded view of exemplary components of an anti-chop eye system that are located under the cover plate 34 on the right side of the body 26. FIG. 19 is a cross-section view taken along lines 19-19 in FIG. 18 and shows first lens 520 and second lens 540 of the anti-chop eye system disposed on opposite sides of the body 26. The anti-chop eye system includes a first lens 520 and a transmitter 500 on a first side of the body 26. The system further includes a second lens 540 and a receiver 510 disposed generally on the opposite side of the body 26. Wires from the receiver 510 and the transmitter 500 are routed through the housing 26 to the electronics in the handgrip frame 24. The processor running the software processes the data signal received from the receiver 510 to determine whether the paintball is properly positioned and allows the pneumatic paintball marker 20 to fire the paintball if the paintball is properly positioned.

The first lens 520 is preferably positioned relative to the second lens 540 so that the light beam exiting the first lens 520 passes through the second lens 540 and is sensed by the receiver 510. The first lens 520 and the second lens 540 are located below the longitudinal axis of the barrel 22 or on the side of the longitudinal axis that is closest to the handgrip frame 24. The second lens 540 need not be on the diametrically opposite side of the breech relative to the location of the first lens 520. The second lens 540 need only be positioned around the breech so that a light beam passing between the first lens 520 and the second lens 540 crosses a portion of the breech.

Of course the first lens 520 and the second lens 540 could switch positions so that the first lens 520 is on the left side of the body 26 and the second lens 540 is on the right side of the body 26. The transmitter 500 could be associated with the second lens 540 with the receiver 510 being associated with the first lens 520.

In the illustrated embodiment, the transmitter 500 is on one side of the breech and the receiver 510 is on the opposite side of the breech. The transmitter 500 transmits a light beam across the barrel cavity and towards the second lens 540. The light beam may include one or more wavelengths of light.

In order for the marker 20 to fire with the anti-chop eyes turned on, the signal between the first and second lenses 520, 540 must be broken or at least diminished. After every shot and before the next paintball drops in the breech, the receiver 510 recognizes the transmitter 500. Preferably, if the lenses 520, 540 are dirty and the receiver 510 cannot see the transmitter 500 between shots, the status lamp 47 alerts the user.

The pneumatic marker 20 preferably further includes ball detents 530 on either side of the body 26. The ball detents 530 may be made of rubber or other like material. The ball detents 530 retain the paintballs in position between the transmitter 500 and the receiver 510 prior to the firing of the pneumatic paintball marker 20. The ball detents 530 inhibit the paintball positioned within the breech from rolling down the breech and out of the barrel 22. The ball detents 530 may also inhibit "double feeding" of paintballs.

The first lens 520 is preferably separate from the second lens 540. In other embodiments, the first and second lenses 520, 540 can be part of a single assembly that is installed within the body 26. For example, the first and second lenses 520, 540 could be attached to a circular or horseshoe shaped insert. The insert is inserted into a slit or gap in the body 26 so that a beam passing between the first lens 520 and the second lens 540 passes through at least a portion of the breech so as to sense the presence of a paintball within the breech.

In the illustrated embodiment, each lens 520, 540 is a separate component from the transmitter 500 and the receiver 510. With this embodiment, an off-the-shelf transmitter 500 and receiver 510 may be employed in combination with the lens 520, 540. The receiver 510 and transmitter 500 may be combined into a single unit or transceiver as known to one having ordinary skill in the art.

Alternatively, the transmitter 500 includes an integral casing. For example, the first lens 520 may be integral to the transmitter 500. In such an embodiment, the outer surface of the casing or lens of the transmitter 500 preferably follows the radius of the breech and/or a portion of the main cylinder 84 which wipes the surface of the casing. The receiver 510 may include an integral casing that also follows the radius of the breech and/or the portion of the main cylinder 84 which wipes the surface of the casing.

The first and second lenses 520, 540 preferably pass through a predetermined wavelength of light. In certain embodiments, the anti-chop eye system includes one or more filters. For example, the receiver 510 and/or second lens 540 may include a filter medium which allows the predetermined wavelength of light to pass therethrough. The filter medium may filter other wavelengths of light which may interfere with the receiver 510 sensing the predetermined wavelength of light. Of course the filter medium may be a separate component of the anti-chop eye system and disposed in the path of the beam of light so that the beam of light passes through the filter. A polarizer may also be employed in the anti-chop eye system. The polarizer converts an unpolarized or mixed-polarization beam of electromagnetic waves (e.g., light) into a beam with a single polarization state.

Preferably, the intensity of the chosen wavelength does not appreciable drop as the light passes through the first and second lenses 520, 540 or at least maintains an adequate intensity so that the intensity of the light received by the receiver 510 may be sensed by the receiver 510. Exemplary materials for the lenses 520, 540 include plastics, glass, ceramics, or the like that allow the predetermined wavelength of light for the anti-chop eye system to pass there through. For example, the lenses may comprise an acrylic resin, a polycarbonate material, another thermoplastic material, or the like. Preferably, the lenses 520, 540 comprise a clear plastic or glass material.

Although this invention has been disclosed in the context of a certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. A marker comprising:

an outer member having an opening disposed generally axially therethrough and a gas inlet passage;

a sliding member slidingly received within the outer member and configured to move between a first position and a second position, the second position being aft of the first position;

a first chamber positioned within the outer member and configured to be in flow communication with the gas inlet passage when the sliding member is in the first position and in the second position;

a second chamber positioned within the outer member and configured to be in flow communication with the first chamber at least when the sliding member is in the second position; and a passageway disposed between the first chamber and the second chamber, the passageway being sized with respect to the gas inlet passage so as to impede the gas entering the second chamber from entering the first chamber at least when the sliding member is moving from the first position to the second position.

2. The marker of claim 1, wherein the sliding member moves axially towards the second position when the gas enters the second chamber.

3. The marker of claim 2, wherein the sliding member is biased towards the first position when the gas fills the first chamber.

4. The marker of claim 1, further comprising a sear, the sear engaging the sliding member at least when the sliding member is in the first position.

5. The marker of claim 4, wherein the sliding member moves axially towards the first position when the sliding member is disengaged from the sear.

6. The marker of claim 1, wherein a cross-section of the gas inlet passage is unchanged when the sliding member moves between the first position and said second position.

7. The marker of claim 1, wherein the first chamber is at least partially defined between the outer member and the sliding member.

8. The marker of claim 1, wherein the second chamber is at least partially defined within the sliding member.

9. A marker comprising:

a pressurized gas source;

an outer member having an opening disposed generally axially therethrough;

a gas inlet passage formed in the outer member and being in flow communication with the pressurized gas source;

a sliding member received within the opening disposed in the outer member and configured to slide between a first position and a second position that is aft of the first position, the sliding member having a first pressure surface;

a first chamber and a second chamber positioned within the marker; and a passageway disposed between the first chamber and the second chamber;

wherein:

the second chamber is configured to be in flow communication with the gas inlet passage when the sliding member is in the first position and in the second position;

the first chamber has a second pressure surface sized and configured so that the sliding member is biased towards the first position when the first chamber and the second chamber are at substantially equal pressures; and the passageway is sized so as to slow the gas entering the second chamber from entering the first chamber at least when the sliding member is moving from the first position to the second position.

10. The marker of claim 9, further comprising an exit channel in flow communication with the second chamber at least when the sliding member is in the first position, at least some of the gas entering the exit channel from the second chamber propelling a paintball from the marker, wherein the open area is disposed so that at least some of the gas in the first chamber enters the exit channel when the sliding member is moving toward the first position without passing through the second chamber.

11. The marker of claim 10, wherein the open area is disposed so that at least some of the gas in the first chamber enters the exit channel when the sliding member is moving toward the first position without passing through the second chamber.

12. The marker of claim 10, wherein the second pressure surface substantially opposes the first pressure surface.

13. A gas pressurized paintball marker comprising:

a housing comprising an opening disposed generally axially therethrough and defining one or more interior surfaces;

a sliding member slidably received by the one or more interior surfaces of the opening, the sliding member being slideable between at least a first and a second position;

a frame configured to support the housing and having a handgrip portion;

a release mechanism configured to releasably hold the sliding member in a third position, the third position being axially between the first and second positions; and a first air chamber and a second air chamber defined within the housing;

wherein:

the first and second chambers are pressurized at least when the sliding member is in the third position; and the sliding member moves axially away from the first position in response to the pressurized gas filling the first air chamber.

14. The marker of claim 13, wherein the release mechanism comprises a sear member that releasably engages the sliding member at the third position.

15. The marker of claim 13, further comprising a trigger disposed within the frame, the trigger being configured to activate the release mechanism when the trigger is actuated.

16. The marker of claim 13, wherein the sliding member moves axially toward the first position in response to the pressurized gas filling the second air chamber.

17. The marker of claim 13, wherein the sliding member is configured to move axially to the third position in response to the pressurized gas filling the second air chamber.

18. The marker of claim 13, wherein the sliding member and the opening in the housing are configured such that a pressurized gas first substantially pressurizes the first air chamber before substantially pressurizing the second air chamber.

19. The marker of claim 13, wherein the sliding member is configured to move axially toward the first position when the sliding member is released from the third position.

20. The marker of claim 13, wherein the sliding member is configured to release the pressurized gas within the second air chamber through the opening in the housing at least when the sliding member is in the first position, propelling a paintball out of the marker.

21. The marker of claim 13, wherein a paintball is propelled by the marker when the sliding member is approximately in the fore position.

22. The marker of claim 13, wherein the opening defines one or more cylindrical surfaces.

23. The marker of claim 13, wherein the sliding member defines one or more cylindrical surfaces.

24. The marker of claim 13, wherein the marker further comprises a valve to reduce the pressure of the pressurized gas within at least one of the first air chamber and the second air chamber.

25. The marker of claim 13, wherein the marker is configured such that a pressurized gas supplied to the first air chamber is constant.

26. The marker of claim 13, wherein the second air chamber is at least partially defined within an axial opening in the sliding member.

* * * * *